US008699892B2

(12) United States Patent
Iio et al.

(10) Patent No.: US 8,699,892 B2
(45) Date of Patent: Apr. 15, 2014

(54) METHOD OF EVALUATING ELECTROPHOTOGRAPHIC OVERCOATABILITY OF COMPOSITION, ELECTROPHOTOGRAPHIC OVERCOAT COMPOSITION, ELECTROPHOTOGRAPHIC METHOD, AND ELECTROPHOTOGRAPHIC APPARATUS

(75) Inventors: Masato Iio, Kanagawa (JP); Tsuyoshi Asami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 199 days.

(21) Appl. No.: 13/417,600

(22) Filed: Mar. 12, 2012

(65) Prior Publication Data

US 2012/0243890 A1 Sep. 27, 2012

(30) Foreign Application Priority Data

Mar. 23, 2011 (JP) ..... 2011-064086

(51) Int. Cl.
*G03G 15/00* (2006.01)

(52) U.S. Cl.
USPC ..... 399/15; 399/39

(58) Field of Classification Search
USPC ..... 399/15, 39, 40, 130, 341, 342
See application file for complete search history.

(56) References Cited

U.S. PATENT DOCUMENTS

| | | | | |
|---|---|---|---|---|
| 6,103,440 | A * | 8/2000 | Lohr | 430/110.1 |
| 7,132,644 | B2 * | 11/2006 | Grunert et al. | 250/226 |
| 7,675,620 | B2 * | 3/2010 | Imura | 356/402 |
| 2006/0092412 | A1 * | 5/2006 | Doshoda et al. | 356/243.1 |
| 2011/0206429 | A1 | 8/2011 | Terao et al. | |
| 2011/0223527 | A1 | 9/2011 | Iio et al. | |

FOREIGN PATENT DOCUMENTS

| | | |
|---|---|---|
| JP | 1-163747 | 6/1989 |
| JP | 10-309876 | 11/1998 |
| JP | 2007-277547 | 10/2007 |

* cited by examiner

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

A method of evaluating electrophotographic overcoatability of a composition is provided. The method includes measuring a color (C1) of a toner image fixed on a sheet, dropping the composition on the toner image, and removing the composition from the toner image. The method further includes measuring a color (C2) of the toner image from which the composition has been removed, and calculating a color difference between the color (C1) of the toner image and the color (C2) of the toner image on which the composition is dropped and from which the composition is removed thereafter.

10 Claims, 5 Drawing Sheets

METHOD OF EVALUATING ELECTROPHOTOGRAPHIC OVERCOATABILITY OF COMPOSITION, ELECTROPHOTOGRAPHIC OVERCOAT COMPOSITION, ELECTROPHOTOGRAPHIC METHOD, AND ELECTROPHOTOGRAPHIC APPARATUS

CROSS-REFERENCE TO RELATED APPLICATIONS

This patent application is based on and claims priority pursuant to 35 U.S.C. §119 to Japanese Patent Application No. 2011-064086, filed on Mar. 23, 2011, in the Japanese Patent Office, the entire disclosure of which is hereby incorporated herein by reference.

BACKGROUND

1. Technical Field

The present disclosure relates to a method of evaluating electrophotographic overcoatability of a composition, an electrophotographic overcoat composition, an electrophotographic method, and an electrophotographic apparatus.

2. Description of Related Art

On-demand printing is extensively applied recently, which responds to recent demand for rapid output of variable information.

On-demand printing apparatuses are of two main types: electrophotographic apparatuses and inkjet apparatuses. In particular, electrophotographic apparatuses that reproduce image information with toner are more widely used.

An electrophotographic apparatus is generally equipped with a fixing device that fixes toner on a recording medium with a fixing roller. The fixing roller is applied with a large amount of oil so that the toner is easily releasable from the fixing roller. There have been a problem that the oil undesirably contaminates the recording medium and another problem that the fixing device becomes more expensive, more complicated, and larger due to installation of an oil container.

In view of this situation, a more simplified fixing device which does not use oil (hereinafter "oilless fixing device") is strongly needed. Simultaneously, a toner applicable to the oilless fixing device is also needed. In response to this need, a toner including a wax has been proposed.

Brochures and book covers printed by on-demand printing sometimes need to be protected from water or contamination or to have appropriate gloss depending on their purpose of use. In these cases, a transparent layer is formed on the printed surface. The transparent layer may be formed on the printed surface by, for example, overcoating, vinyl coating, press coating, or film pasting. Among these various processing procedures, overcoating with a varnish is widely preferred for its simplicity.

As to overcoating technique in electrophotography, Japanese Patent Application Publication No. 2007-277547 describes a water-based ammonia-free varnish composition having a low static surface tension for overcoating printed materials on which a fixing oil is applied. Japanese Patent Application Publication No. 10-309876 describes an image forming apparatus including a resin layer forming device that forms a silicone resin layer on a printed surface. Japanese Patent Application Publication No. 01-163747 describes an electrophotographic printing method applicable to metal containers.

In the above-described techniques, however, there is a limit in choosing a suitable combination of a toner composition and an overcoat composition. Even in a case in which an overcoat composition can be applied to a toner image formed on a recording medium, the resulting overcoat layer sometimes peels off from the toner image due to weak adhesion. In particular, when the toner includes a wax, peeling off of the overcoat layer significantly occurs. In some cases, the overcoat composition is repelled from the toner image and cannot be applied to the toner image.

In view of these situations, there is a need for a method of evaluating electrophotographic overcoatability of compositions. Additionally, there are also needs for an electrophotographic overcoat composition which is adhesive to toner images without repelling, and an image forming method and apparatus using such an electrophotographic overcoat composition.

SUMMARY

In accordance with some embodiments, a method of evaluating electrophotographic overcoatability of a composition is provided. The method includes measuring a color (C1) of a toner image fixed on a sheet, dropping the composition on the toner image, and removing the composition from the toner image. The method further includes measuring a color (C2) of the toner image from which the composition has been removed, and calculating a color difference between the color (C1) of the toner image and the color (C2) of the toner image on which the composition is dropped and from which the composition is removed thereafter.

In accordance with some embodiments, an electrophotographic overcoat composition is provided. The electrophotographic overcoat composition includes a polymerizable unsaturated compound. A color difference $\Delta E^*$ defined in the $L^*a^*b^*$ color system between a color (C1) of a toner image and a color (C2) of the toner image on which the electrophotographic overcoat composition in an amount of 0.3 to 0.5 $mg/cm^2$ is dropped from a height of 10 mm and from which the electrophotographic overcoat composition is removed 10 seconds after is within a range of 3 to 30.

In accordance with some embodiments, an electrophotographic method is provided. The method includes charging a surface of an electrophotographic photoreceptor, irradiating the charged surface of the electrophotographic photoreceptor with light containing image information to form an electrostatic latent image thereon, developing the electrostatic latent image into a toner image with a toner; transferring the toner image onto a recording medium, fixing the toner image on the recording medium, and forming a layer of the above electrophotographic overcoat composition on the toner image on the recording medium.

In accordance with some embodiments, an electrophotographic apparatus is provided. The apparatus includes an electrophotographic photoreceptor, a charger to charge a surface of the electrophotographic photoreceptor, an irradiator to irradiate the charged surface of the electrophotographic photoreceptor with light containing image information to form an electrostatic latent image thereon, a developing device to develop the electrostatic latent image into a toner image with a toner, a transferring device to transfer the toner image onto a recording medium, a fixing device to fix the toner image on the recording medium, and an overcoat layer forming device to form a layer of the electrophotographic overcoat composition according to Claim 3 on the toner image on the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
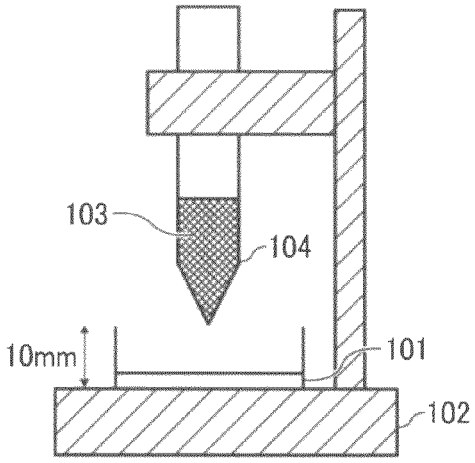
FIG. 1 is a schematic view of an overcoat composition dropping apparatus for use in a method according to an embodiment.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

A method of evaluating electrophotographic overcoatability of a composition according to an embodiment includes measuring a color (C1) of a toner image fixed on a sheet, dropping the composition on the toner image, removing the composition from the toner image, measuring a color (C2) of the toner image from which the composition has been removed, and calculating a color difference between the color (C1) of the toner image and the color (C2) of the toner image on which the composition is dropped and from which the composition is removed thereafter.

The method evaluates electrophotographic overcoatability of a composition in terms of wettability, adhesiveness, and effect on images. The wettability is defined as repellency of the composition from the toner image. The adhesiveness is defined as adhesiveness of a resulting overcoat layer, formed by hardening the composition, to the toner image. The effect on image is determined based on whether the toner image is disturbed or not upon melting of the composition.

The method of evaluating electrophotographic overcoatability of a composition may be considered as a toner melting test which includes the following steps S11 to S17.

In a step S11, a toner image is formed by adhering 0.6 to 1.0 mg/cm$^2$ of a toner comprising a colorant and a resin to an OHP (overhead projector) sheet 101 and fixing it thereon. Lightness L1 and chromaticity coordinates a1 and b1, defined in the L*a*b* color system, of the toner image are measured.

In a step S12, the OHP sheet 101 having the toner image thereon is set to an overcoat composition dropping apparatus 102 (i.e., a melting tester) illustrated in FIG. 1.

In a step S13, a predetermined amount (i.e., 0.3 to 0.5 mg/cm$^2$) of an overcoat composition 103 is dropped on the OHP sheet 101 with a dropping burette 104 from a height of 10 mm.

In a step S14, the overcoat composition is removed from the toner image after a lapse of predetermined time period (e.g., 10 seconds).

In a step S15, lightness L2 and chromaticity coordinates a2 and b2, defined in the L*a*b* color system, of the toner image from which the overcoat composition has been removed are measured.

In a step S16, the color difference ΔE* is calculated from the following formula (1):

$$\Delta E^*=((a2-a1)^2+(b2-b1)^2+(L2-L1)^2)^{1/2} \quad (1)$$

In a step S17, whether or not the measured color difference ΔE* is within a predetermined specified value range is determined. When the color difference ΔE* is within the specified value range, the overcoat composition is regarded as being suitable for an electrophotographic overcoat composition. When the color difference ΔE* is beyond the specified value range, the overcoat composition is regarded as not being suitable for an electrophotographic overcoat composition. Overcoat compositions which produce a ΔE* within the specified value range are suitable for electrophotographic overcoat compositions.

When ΔE* is within the specified value range, the above-defined wettability, adhesiveness, and effect on images are also within the acceptable range. When ΔE* falls below the specified value range, the above-defined wettability and adhesiveness may deteriorate. When ΔE* exceeds the specified value range, the resulting images may be disturbed. In some embodiments, the specified range is defined by the following formula:

$$3 \leq \Delta E^* \leq 30$$

An electrophotographic overcoat composition according to an embodiment includes a polymerizable unsaturated compound. A color difference ΔE* defined in the L*a*b* color system between a color (C1) of a toner image and a color (C2) of the toner image on which the electrophotographic overcoat composition in an amount of 0.3 to 0.5 mg/cm$^2$ is dropped from a height of 10 mm and from which the electrophotographic overcoat composition is removed 10 seconds after is within a range of 3 to 30.

The chemical species and content of the polymerizable unsaturated compound are determined so that the resulting electrophotographic overcoat composition provides a color difference ΔE* within the specified value range. The color difference ΔE* represents the degree of melt of the toner image. When the color difference ΔE* is within the specified value range, it means that the electrophotographic overcoat composition properly melts the toner image to intimately adhere thereto without disturbing the toner image.

Typical overcoat compositions may be repelled from or poorly adhesive to wax-containing toners. In particular, typical overcoat compositions may be significantly repelled from or poorly adhesive to toners including a low-polarity paraffin wax.

By contrast, the electrophotographic overcoat composition according to an embodiment has solved this problem because of including a suitable polymerizable unsaturated compound in a suitable amount. The chemical species and content of the polymerizable unsaturated compound is selected based on the above-described method of evaluating electrophotographic overcoatability of a composition.

An overcoat composition providing a color difference ΔE in the specified value range is considered to have affinity for binder resins in the toner. Thus, such an overcoat composition can rapidly and properly permeate the toner.

The electrophotographic overcoat composition may include, for example, a polymerizable oligomer, a polymerizable unsaturated compound, a photopolymerization initiator, a sensitizer, a polymerization inhibitor, and a surfactant.

Specific examples of usable polymerizable oligomers include, but are not limited to, polyester acrylates, epoxy acrylates, and urethane acrylates.

Specific examples of the polyester acrylates include, but are not limited to, an acrylate of a polyester polyol obtained from a polyol and a polybasic acid. The polyester acrylates have excellent reactivity.

Specific examples of the epoxy acrylates include, but are not limited to, those obtained from a reaction of an acrylic acid with a bisphenol-type epoxy, a novolac-type epoxy, or an alicyclic epoxy. The epoxy acrylates have excellent hardness, flexibility, and curability.

Specific examples of the urethane acrylates include, but are not limited to, those obtained from a reaction of a polyester polyol or a polyether polyol with a diisocyanate and an acrylate having a hydroxyl group. The urethane acrylates can produce a flexible and tough layer.

Two or more of the above-described polymerizable oligomers can be used in combination.

In some embodiments, the content of the polymerizable oligomer in the electrophotographic overcoat composition is 5 to 60% by weight, 10 to 50% by weight, or 20 to 45% by weight. When the content is less than 5% % by weight, defective curing may occur, the viscosity of the composition may be too low, or the resulting layer may have poor flexibility. When the content is greater than 60% % by weight, the resulting layer may be less adhesive to toner or the viscosity of the composition may be too high. When the content of the polymerizable oligomer is within the above-described range, the composition provides proper viscosity and curability and the resulting layer provides proper flexibility and strength.

Usable polymerizable unsaturated compounds may be either monofunctional, difunctional, trifunctional, tetrafunctional, or more functional.

Specific examples of usable monofunctional polymerizable unsaturated compounds include, but are not limited to, 2-ethylhexyl acrylate, 2-hydroxymethyl acrylate, 2-hydroxyethyl acrylate, 2-hydroxypropyl acrylate, benzyl acrylate, phenyl glycol monoacrylate, and cyclohexyl acrylate.

Specific examples of usable difunctional polymerizable unsaturated compounds include, but are not limited to, 1,4-butanediol diacrylate, 1,6-hexanediol diacrylate, 1,9-nonanediol diacrylate, tripropylene glycol diacrylate, and tetraethylene glycol diacrylate.

Specific examples of usable trifunctional polymerizable unsaturated compounds include, but are not limited to, trimethylolpropane triacrylate, pentaerythritol triacrylate, and tris (2-hydroxyethyl)isocyanurate triacrylate.

Specific examples of usable tetrafunctional or more functional polymerizable unsaturated compounds include, but are not limited to, pentaerythritol tetraacrylate, ditrimethylolpropane tetraacrylate, dipentaerythritol hydroxypentaacrylate, and dipentaerythritol hexaacrylate.

Among these materials, 1,6-hexanediol diacrylate, ethylcarbitol acrylate, and acryloyl morpholine have high toner-melting power. The content of each material is determined based on its toner-melting power. When the content is too small, the resulting layer may be less adhesive to toner. When the content is too large, the resulting image may be disturbed.

Two or more of the above-described polymerizable unsaturated compounds can be used in combination.

In some embodiments, the content of the polymerizable unsaturated compound in the electrophotographic overcoat composition is 35 to 90% by weight, 45 to 85% by weight, or 40 to 75% by weight. When the content is less than 35% % by weight, the resulting layer may be less adhesive to toner or the viscosity of the composition may be too high. When the content is greater than 90% % by weight, defective curing may occur, the viscosity of the composition may be too low, or the resulting layer may have poor flexibility. When the content of the polymerizable unsaturated compound is within the above-described range, the composition provides proper viscosity and curability and the resulting layer provides proper flexibility and strength.

As the number of functional groups increases, the curing speed increases. Thus, polyfunctional polymerizable compounds are more suitable for use in high-speed fixing systems, but they cause significant volume contraction. Significant volume contraction undesirably causes curling. Therefore, preferably, the volume contraction ratio of the polymerizable unsaturated compound is 15% or less.

In some embodiments, the polymerizable unsaturated compound and the polymerizable oligomer each have a dermal irritancy index P.I.I. of 1.0 or less. When P.I.I. is 5.0 or more, such compounds are highly irritating to skin.

In some embodiments, the polymerizable unsaturated compound and the polymerizable oligomer each are substantially colorless and transparent. In some embodiments, they have a Gardner's gray scale of 2 or less. When the Gardner's gray scale is greater than 2, the resulting image may change its color from the original image or background portions of the image may be highly visible.

Specific examples of usable photopolymerization initiators include, but are not limited to, benzophenone, benzoin ethyl ether, benzoin isopropyl ether, and benzyl. Specific examples of commercially-available photopolymerization initiators include, but are not limited to, IRGACURE 1300, IRGACURE 369, and IRGACURE 907 (from Ciba Specialty Chemicals), and LUCIRIN TPO (from BASF Japan).

When a mixture of the polymerizable oligomer or polymerizable unsaturated compound with the photopolymerization initiator is exposed to ultraviolet ray, the photopolymerization initiator produces a radical as shown in the following schemes (I) and (II). The radical causes an addition reaction to polymerizable double bonds in the polymerizable oligomer or polymerizable unsaturated compound. The addition reaction produces a further radical, and the produced radical further causes an addition reaction to other polymerizable double bonds in the polymerizable oligomer or polymerizable unsaturated compound. This addition reaction is repeatedly caused as shown in the following scheme (III).

(I) Hydrogen Abstraction Type

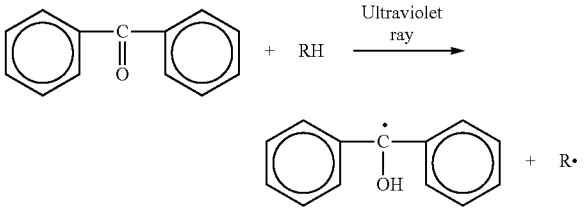

(II) Optical Cleavage Type

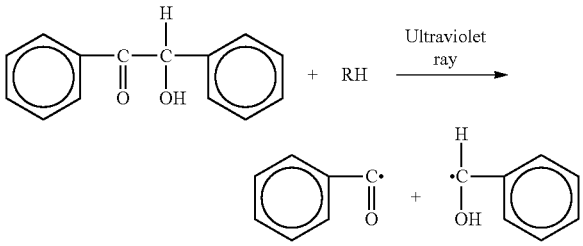

(III) Polymerization

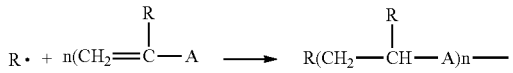

In some embodiments, the photopolymerization initiator has (i) a high ultraviolet ray absorption efficiency, (ii) a high solubility in the polymerizable oligomer or polymerizable unsaturated compound, (iii) a low odor, yellowing property, and toxicity, and (iv) dark reaction resistance.

In some embodiments, the content of the photopolymerization initiator in the electrophotographic overcoat composition is 1 to 10% by weight or 2 to 5% by weight.

A benzophenone-based photopolymerization initiator that causes the hydrogen abstraction type reaction shown in the scheme (I) may decelerate the reaction. In this case, an amine-based sensitizer can be used in combination with the photopolymerization initiator to improve reactivity. The amine-based sensitizer supplies hydrogen to the photopolymerization initiator from which hydrogen has been abstracted, and prevents the reaction from being inhibited by oxygen existing in the air.

Specific examples of usable amine-based sensitizers include, but are not limited to, triethanolamine, triisopropanolamine, 4,4-diethylamino benzophenone, 2-dimethylaminoethyl benzoic acid, ethyl 4-dimethylaminobenzoate, and isoacyl 4-dimethylaminobenzoate.

In some embodiments, the content of the sensitizer in the electrophotographic overcoat composition is 1 to 15% by weight or 3 to 8% by weight.

The electrophotographic overcoat composition may include a polymerization inhibitor for the purpose of improving storage stability. Specific examples of usable polymerization inhibitors include, but are not limited to, 2,6-di-tert-butyl-p-cresol (BHT), 2,3-dimethyl-6-tert-butyl phenol (IA), anthraquinone, hydroquinone (HQ), and hydroquinone monomethyl ether (MEHQ).

In some embodiments, the content of the polymerization inhibitor in the electrophotographic overcoat composition is 0.5 to 3% by weight.

When the electrophotographic overcoat composition includes a surfactant, adsorptive force to toner and wettability are improved because surface tension is decreased. Usable surfactants include anionic surfactants, nonionic surfactants, silicone surfactants, and fluoro surfactants.

Specific examples of usable anionic surfactants include, but are not limited to, sulfosuccinate, disulfonate, phosphate, sulfate, sulfonate, and mixtures thereof.

Specific examples of usable nonionic surfactants include, but are not limited to, polyvinyl alcohol, polyacrylic acid, isopropyl alcohol, acetylene-based diol, ethoxylated octyl phenol, ethoxylated branched secondary alcohol, perfluorobutane sulfonate, and alkoxylated alcohol.

Specific examples of usable silicone surfactants include, but are not limited to, polyether-modified polydimethyl siloxane.

Specific examples of usable fluoro surfactants include, but are not limited to, ethoxylated nonyl phenol.

In some embodiments, the content of the surfactant in the electrophotographic overcoat composition is 0.1 to 5% by weight or 0.5 to 3% by weight. When the content is less than 0.1% by weight, wettability may be poor. When the content is greater than 0.5% by weight, curability may be poor. When the content of the surfactant is within the above-described range, the composition provides proper wettability.

The electrophotographic overcoat composition may further include a leveling agent, a matting agent, a wax for controlling film property, and a tackifier which does not inhibit the polymerization for improving adhesion to recording media such as polyolefin or PET.

In some embodiments, the electrophotographic overcoat composition has a viscosity of 10 to 800 mPa·s at 25° C. When the viscosity is less than 10 mPa·s or greater than 800 mPa·s, it may be difficult to control its thickness. The viscosity can be measured by a B-type viscometer (from Toyo Seiki Seisakusho, Ltd.).

The electrophotographic overcoat composition may be either oil-based or ultraviolet curable (photocurable). The latter is more safety, environmentally-friendly, energy-saving, and higher-producing.

A toner for use in methods and apparatuses according to some embodiments includes a binder resin and a colorant and optionally includes other components such as a wax.

Specific examples of usable binder resins include, but are not limited to, homopolymers of styrene or styrene derivatives (e.g., polystyrene, poly-p-styrene, polyvinyl toluene), styrene-based copolymers (e.g., styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer), polymethyl methacrylate resins, polybutyl methacrylate resins, polyvinyl chloride resins, polyvinyl acetate resins, polyethylene resins, polyester resins, polyurethane resins, epoxy resins, polyvinyl butyral resins, polyacrylic acid resins, rosin resins, modified rosin resins, terpene resins, phenol resins, aliphatic or alicyclic hydrocarbon resins, and aromatic petroleum resins. Two or more of these resins can be used in combination. In some embodiments, polyester resins are used in view of its affinity for recording media.

A polyester resin is obtained from an alcohol, such as a diol and a polyol having 3 or more valences, and an acid.

Specific examples of usable diols include, but are not limited to, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols obtained from a reaction between a cyclic ether (e.g., ethylene oxide, propylene oxide) and bisphenol A.

Specific examples of usable polyols having 3 or more valences include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Specific examples of usable acids include, but are not limited to, benzene dicarboxylic acids (e.g., phthalic acid, isophthalic acid, terephthalic acid) and anhydrides thereof, alkyl dicarboxylic acids (e.g., succinic acid, adipic acid, sebacic acid, azelaic acid) and anhydrides thereof, unsaturated dibasic acids (e.g., maleic acid, citraconic acid, itaconic acid, alkenylsuccinic acid, fumaric acid, mesaconic acid), unsaturated dibasic acid anhydrides (e.g., maleic acid anhydride, citraconic acid anhydride, itaconic acid anhydride, alkenylsuccinic acid anhydride), and polycarboxylic acids having 3 or more valences.

Specific examples of usable polycarboxylic acids having 3 or more valences include, but are not limited to, trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, enpol trimmer acid, and anhydrides and partial lower alkyl esters of these compounds.

The binder resin may include a modified polyester reactive with a compound having an active hydrogen group. The compound having an active hydrogen group acts as an elongater or a cross-linker for elongating or cross-linking the modified polyester reactive with the compound having an active hydrogen group. Elongated and/or cross-linked modified polyester reactive with compound having an active hydrogen group makes heat-resistant storage stability of the resulting toner improved and the resulting image less sticky. The modified polyester has a site reactive with the compound having an active hydrogen group. The site may be, for example, an isocyanate group, an epoxy group, a carboxyl group, or an acid chloride group. In some embodiments, the modified polyester has an isocyanate group.

In some embodiments, the modified polyester has an isocyanate group and the compound having an active hydrogen group is an amine. This combination can produce a high-molecular-weight polyester by elongating and/or cross-linking reactions.

Specific examples of usable amines include, but are not limited to, phenylenediamine, diethyltoluenediamine, 4,4'-diaminodiphenylmethane, 4,4'-diamino-3,3'-dimethyldicyclohexylmethane, diaminocyclohexane, isophoronediamine, ethylenediamine, tetramethylenediamine, hexamethylenediamine, diethylenetriamine, triethylenetetramine, ethanolamine, hydroxyethylaniline, aminoethyl mercaptan, aminopropyl mercaptan, aminopropionic acid, and aminocaproic acid. Additionally, ketimine compounds, in which amino group in an amine is blocked with a ketone (e.g., acetone, methyl ethyl ketone, methyl isobutyl ketone), and oxazoline compounds are also usable.

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these materials can be used in combination.

In some embodiments, the content of the colorant in the toner is 1 to 15 parts by weight or 3 to 10 parts by weight based on 100 parts by weight of the toner.

The colorant can be combined with a resin to be used as a master batch. Specific examples of usable resins for the master batch include, but are not limited to, polymers of styrene or styrene derivatives, styrene-based copolymers, polymethyl methacrylate resins, polybutyl methacrylate resins, polyvinyl chloride resins, polyvinyl acetate resins, polyethylene resins, polypropylene resins, epoxy resins, epoxy polyol resins, polyurethane resins, polyamide resins, polyvinyl butyral resins, polyacrylic acid resins, rosin, modified rosin, terpene resins, aliphatic or alicyclic hydrocarbon resins, aromatic petroleum resins, chlorinated paraffin, and paraffin wax. Two or more of these resins can be used in combination.

Usable waxes include, but are not limited to, petroleum waxes, having high releasing property. Specific examples of usable petroleum waxes include, but are not limited to, paraffin wax, microcrystalline wax, and mixed waxes of paraffin wax with microcrystalline wax.

In some embodiments, the electrophotographic overcoat composition includes a wax including isoparaffin in an amount 10% by weight or more.

In some embodiments, the wax has a similar molecular weight to the electrophotographic overcoat composition in view of adhesiveness. For example, in some embodiments, the wax has an average molecular weight of 500 or more, which improves adhesiveness to the electrophotographic overcoat composition.

Isoparaffin content in the wax and average molecular weight of the wax can be measured by a Field Desorption method using an instrument JMS-T100GC AccuTOF GC.

Figure 2:
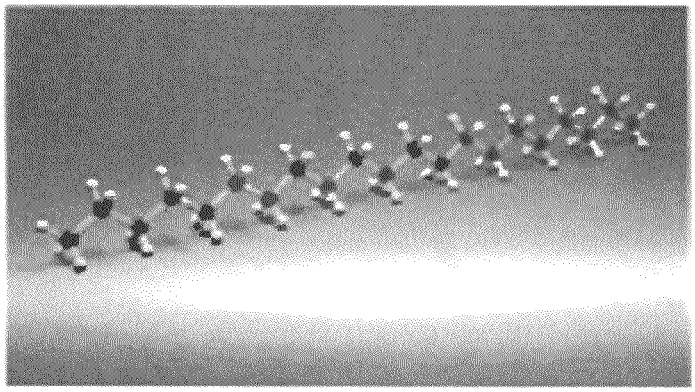
FIG. 2 and FIG. 3 are structural views of normal paraffin and isoparaffin, respectively.
Figure 3:
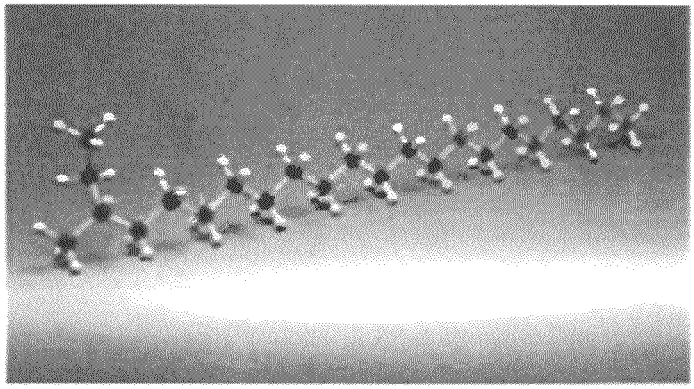

FIG. 2 and FIG. 3 are structural views of normal paraffin and isoparaffin, respectively. Normal paraffin has a straight-chain structure and isoparaffin has a branched-chain structure. In the straight-chain structure, molecules are arranged evenly and regularly. Therefore, normal paraffin has a relatively small polarity. In the branched-chain structure, molecules are arranged unevenly and irregularly. Therefore, isoparaffin has a greater polarity than normal paraffin. The higher the polarity, the better the wettability to the electrophotographic overcoat composition.

In some embodiments, the wax has a melting point of 40 to 160° C. or 50 to 120° C. When the melting point is less than 40° C., heat-resistant storage stability of the toner may be poor. When the melting point is greater than 160° C., cold offset resistance of the toner may be poor.

In some embodiments, the wax has a melt-viscosity of 5 to 1,000 cps or 10 to 100 cps at a temperature 20° C. higher than the melting point. When the melt-viscosity is greater than 1,000 cps, hot offset resistance and low-temperature fixability of the toner may be poor.

In some embodiments, the content of the wax in the toner is 0 to 40% by weight or 3 to 30% by weight.

The toner may further include a charge controlling agent, a magnetic material, and an external additive.

The charge controlling agent may be either a positive charge controlling agent or a negative charge controlling agent.

Specific examples of usable negative charge controlling agents include, but are not limited to, resins and compounds having an electron-donating functional group, azo dyes, and metal complexes of organic acids. Specific examples of commercially available negative charge controlling agents include, but are not limited to, BONTRON® S-31, S-32, S-34, S-36, S-37, S-39, S-40, S-44, E-81, E-82, E-84, E-86, E-88, A, 1-A, 2-A, and 3-A (from Orient Chemical Industries Co., Ltd.); KAYACHARGE N-1 and N-2 and KAYASET BLACK T-2 and 004 (from Nippon Kayaku Co., Ltd.); AIZEN SPILON BLACK T-37, T-77, T-95, TRH, and TNS-2 (from Hodogaya Chemical Co., Ltd.); and FCA-1001-N, FCA-1001-NB, and FCA-1001-NZ (from Fujikura Kasei Co., Ltd.). Two or more of these materials can be used in combination.

Specific examples of usable positive charge controlling agents include, but are not limited to, basic compounds such as nigrosine dyes, cationic compounds such as quaternary ammonium salts, and metal salts of higher fatty acids. Specific examples of commercially available positive charge controlling agents include, but are not limited to, BONTRON® N-01, N-02, N-03, N-04, N-05, N-07, N-09, N-10, N-11, N-13, P-51, P-52, and AFP-B (from Orient Chemical Industries Co., Ltd.); TP-302, TP-415, and TP-4040 (from Hodogaya Chemical Co., Ltd.); COPY BLUE® PR and COPY CHARGE® PX-VP-435 and NX-VP-434 (from Hoechst AG); FCA 201, 201-B-1, 201-B-2, 201-B-3, 201-PB, 201-PZ, and 301 (from Fujikura Kasei Co., Ltd.); and PLZ 1001, 2001, 6001, and 7001 (from Shikoku Chemicals Corporation). Two or more of these materials can be used in combination.

In some embodiments, the content of the charge controlling agent is 0.1 to 10 parts by weight or 0.2 to 5 parts by weight, based on 100 parts by weight of the binder resin. When the content of charge controlling agent is greater than 10 parts by weight, the toner may be excessively charged and excessively electrostatically attracted to a developing roller, resulting in poor fluidity of the developer and low image density. When the content of the charge controlling agent is less than 0.1 parts by weight, the toner may not be charged quickly and sufficiently, resulting in poor image quality.

Specific examples of usable magnetic materials include, but are not limited to, (1) magnetic iron oxides (e.g., magnetite, maghemite, ferrite) and iron oxides containing other metal oxides, (2) metals (e.g., iron, cobalt, nickel) and their alloys with aluminum, cobalt, copper, lead, magnesium, tin, zinc, antimony, beryllium, bismuth, cadmium, calcium, manganese, selenium, titanium, tungsten, and vanadium, and (3) mixtures of the above compounds.

Specific examples of usable magnetic materials further include, but are not limited to, $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}2O$, $NiFe_2O_4$, $NdFe_2O$, $BaFe_{12}O_{19}$, $MgFe_2O_4$, $MnFe_2O_4$, $LaFeO_3$, iron powder, cobalt powder, and nickel powder. Two or more of these materials can be used in combination. In some embodiments, fine powders of $Fe_3O_4$ and $\gamma$-$Fe_2O_3$ are used.

In some embodiments, the content of the magnetic material in the toner is 1 to 200 parts by weight or 20 to 150 parts by weight based on 100 parts by weight of the binder resin. The magnetic material may be used as a colorant.

The external additive is adapted to give fluidity, heat-resistant storage stability, developability, transferability, and chargeability to the toner. The external additive may include inorganic fine particles. Specific examples of usable materials for the inorganic fine particles include, but are not limited to, silica, titania, alumina, cerium oxide, strontium titanate, calcium carbonate, magnesium carbonate, and calcium phosphate. Additionally, silica fine particles which are hydrophobized with silicone oil or hexamethyl disilazane and surface-treated titanium oxides are also usable.

Specific examples of commercially available silica fine particles include, but are not limited to, AEROSIL 130, 200V, 200CF, 300, 300CF, 380, OX50, TT600, MOX80, MOX170, COK84, RX200, RY200, R972, R974, R976, R805, R811, R812, T805, R202, VT222, RX170, RXC, RA200, RA200H, RA200HS, RM50, RY200, and REA200 (from Nippon Aerosil Co., Ltd.); HDK-H20, -H2000, -H3004, -H2000/4, -H2050EP, -H2015EP, -H3050EP, and -KHD50, and HVK-2150 (from Wacker Chemie AG); and CABO-SIL L-90, LM-130, LM-150, M-5, PTG, MS-55, H-5, HS-5, EH-5, LM-150D, M-7D, MS-75D, TS-720, TS-610, and TS-530 (from Cabot Corporation). Two or more of these materials can be used in combination.

In some embodiments, the content of the inorganic fine particles in the toner is 0.1 to 5.0 parts by weight or 0.8 to 3.2 parts by weight based on 100 parts by weight of the toner.

In some embodiments, the toner has an average circularity of 0.93 to 1.00 or 0.95 to 0.99. The average circularity is defined as the average of a circularity SR represented by the following formula (2) of each toner particle:

$$SR=Cs/Cp \quad (2)$$

wherein Cp represents a peripheral length of a projected image of a particle and Cs represents a peripheral length of a circle having the same area as the projected image of the particle.

The circularity indicates surface roughness of a toner particle. When the toner particle is a true sphere, the circularity is 1.00. As the surface becomes rougher, the circularity becomes smaller.

When the average circularity is 0.93 to 1.00, it means that the toner particles have a smooth surface. Such toner particles can be efficiently transferred from image bearing member because the contact area between each toner particles or between the toner particle and the image bearing member is small. Additionally, such toner particles with smooth surface do not produce abnormal image because they can be stably agitated in a developing device with only a small agitation torque. Furthermore, such toner particles with smooth surface do not produce defective image because they can be uniformly pressed against a recording medium when being transferred onto it, forming uniform dots. Moreover, such toner particles with smooth surface do not scratch or abrade the surface of the image bearing member.

The circularity SR can be measured with a flow type particle image analyzer FPIA-1000 from Sysmex Corporation in the following procedure. First, add 0.1 to 0.5 ml of a surfactant (preferably an alkylbenzene sulfonate) as a dispersant and 0.1 to 0.5 g of a toner to 100 to 150 ml of water from which solid impurities have been removed in a container. Disperse the toner in the water using an ultrasonic disperser for about 1 to 3 minutes to prepare a suspension. Adjust the suspension concentration such that 3,000 to 10,000 toner particles per micro-liter are included. Subject the suspension to measurement of shape and size of the toner particles using the flow type particle image analyzer.

In some embodiments, the toner has a volume average particle diameter of 3 to 10 μm or 4 to 8 μm. Such a toner has excellent dot reproducibility because the particle size is sufficiently smaller than micro dots forming a latent image. When the volume average particle diameter is less than 3 μm, the toner particles may be inefficiently transferred from image bearing member or may be insufficiently removed with a blade. When the volume average particle diameter is too large, it is difficult to prevent the occurrence of text or line scattering in the produced image.

The volume average particle diameter can be measured by a Coulter counter method using a measuring device COULTER COUNTER TA-II or COULTER MULTISIZER II (both from Beckman Coulter, Inc.) as follows.

First, add 0.1 to 5 mL of a surfactant (e.g., an alkylbenzene sulfonate) to 100 to 150 mL of an electrolyte solution. The electrolyte is an aqueous solution including about 1% of the first grade sodium chloride, such as ISOTON-II (from Beckman Coulter, Inc.). Next, add 2 to 20 mg of a toner to the electrolyte solution. Subject the electrolyte solution containing the toner to a dispersion treatment using an ultrasonic disperser for about 1 to 3 minutes to prepare a suspension. Subject the suspension to a measurement of volume and number distributions of toner particles using the above measuring instrument equipped with a 100-μm aperture. Calculate the volume average particle diameter from the volume distribution measured above.

The following channels are employed during the measurement: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μm and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00 μm; and not less than 32.00 μm and less than 40.30 μm. Accordingly, particles having a particle diameter of not less than 2.00 μm and less than 40.30 μm are subjected to the measurement.

The toner may be manufactured by, for example, a pulverization method; a polymerization method in which monomers are directly polymerized in an aqueous phase, such as a suspension polymerization method and an emulsion polymerization method; a method in which a binder resin solution is emulsified in an aqueous medium; a method in which dissolves toner components in a solvent, removes the solvent, and pulverize the toner components mixture; and a melt spraying method.

In the pulverization method, toner components are melt-kneaded, the melt-kneaded mixture is pulverized into particles, and the particles are classified by size.

Toner particles obtained by the pulverization method may be subjected to shape control by application of mechanical impact force so that the average circularity is increased. Mechanical impact force can be applied from an instrument such as HYBRIDIZER and MECHANOFUSION.

In the pulverization method, first, toner components are mixed and the mixture is melt-kneaded by a melt-kneader. Usable melt-kneaders include single-axis or double-axis continuous kneaders and roll mill batch kneaders. Specific examples of commercially-available melt-kneaders include, but are not limited to, TWIN SCREW EXTRUDER KTK (from Kobe Steel, Ltd.), TWIN SCREW COMPOUNDER TEM (from Toshiba Machine Co., Ltd.), MIRACLE K.C.K (from Asada Iron Works Co., Ltd.), TWIN SCREW EXTRUDER PCM (from Ikegai Co., Ltd.), and KOKNEADER (from Buss Corporation). The melt-kneading conditions are adjusted so as not to cut molecular chains of the binder resin. For example, when the melt-kneading temperature is too much higher than the softening point of the binder resin, molecular chains may be significantly cut. When the melt-kneading temperature is too much lower than the softening point of the binder resin, the raw materials may not be sufficiently kneaded.

Next, the resulting kneaded product is pulverized. The kneaded product may be first pulverized into coarse particles and subsequently pulverized into fine particles. Specific pulverization methods include, for example, a method in which the kneaded product is brought into collision with a collision plate in a jet stream, a method in which particles are brought into collision with each other in a jet stream, and a method in which the kneaded product is pulverized within a narrow gap between mechanically rotating rotor and stator. The resulting particles are classified by size, and particles within a predetermined size range are collected. Undesired fine particles are removed by cyclone separation, decantation, or centrifugal separation, for example.

In the suspension polymerization method, toner components such as a colorant and a release agent are dispersed in an oil-soluble polymerization initiator and polymerizable monomers, and the resulting mixture is emulsified in an aqueous medium containing a surfactant and/or a solid dispersant. The monomers are then subjected to a polymerization reaction.

When the polymerizable monomers include an acid (e.g., acrylic acid, methacrylic acid, α-cyanoacrylic acid, α-cyanomethacrylic acid, itaconic acid, crotonic acid, fumaric acid, maleic acid, maleic anhydride), an amide (e.g., acrylamide, methacrylamide, diacetone acrylamide) or a methylol compound thereof, vinyl pyridine, vinyl pyrrolidone, vinyl imidazole, ethylene imine, an amino-group-containing acrylate or methacrylates, a functional group can be introduced to the resulting toner particles. Alternatively, when a dispersant having an acidic or basic group is used, such a dispersant can be adsorbed to the surfaces of the resulting toner particles so that a functional group is introduced to the toner particles.

In the emulsion polymerization, a water-soluble polymerization initiator and polymerizable monomers are emulsified in water in the presence of a surfactant. The monomers are then subjected to a polymerization reaction to prepare a latex. On the other hand, toner components such as a colorant and a release agent are dispersed in an aqueous medium to obtain a water dispersion of the toner components. The water dispersion and the latex are mixed and the dispersoids are aggregated until the resulting aggregations have a size similar to the toner size. The aggregations are heated so that the dispersoids are fused with each other to form toner particles. A functional group can be introduced to the resulting toner particles when the above-described polymerizable monomers usable for the suspension polymerization are used in preparing the latex.

In the method in which a binder resin solution is emulsified in an aqueous medium includes the following four processes. Here, the binder resin solution is a solution in which at least a binder resin is dissolved, and is hereinafter referred to as "toner components liquid".

Process 1: Preparation of Toner Components Liquid. A toner components liquid is prepared by dissolving or dispersing toner components such as a colorant and a binder resin in an organic solvent. The organic solvent is removed during or after the process of forming toner particles.

Process 2: Preparation of Aqueous Medium. The aqueous medium may include, for example, water, water-miscible alcohol, dimethylformamide, tetrahydrofuran, cellosolve, lower ketone, or a mixture thereof. In one or more embodiments, water is used.

The aqueous medium further contains a dispersant stabilizer, such as fine resin particles. In some embodiments, the added amount of the fine resin particles is 0.5 to 10% by weight. Specific examples of usable resins for the fine resin particles include, but are not limited to, thermoplastic and thermosetting resins such as vinyl resin, polyurethane resin, epoxy resin, polyester resin, polyamide resin, polyimide resin, silicone resin, phenol resin, melamine resin, urea resin, aniline resin, ionomer resin, and polycarbonate resin. Two or more of these resins can be used in combination. Vinyl resins, polyurethane resins, epoxy resins, polyester resins, and combinations thereof are easy to form an aqueous dispersion of fine spherical particles thereof.

The aqueous medium may further contain a dispersant for the purpose of stabilizing liquid droplets of the toner components liquid to obtain toner particles with a desired shape and a narrow particle size distribution. The dispersant may be, for example, a surfactant, a poorly-water-soluble inorganic compound, or a polymeric protection colloid. Two or more of these materials can be used in combination. In some embodiments, a surfactant is used.

Process 3: Emulsification. In emulsifying the toner components liquid in the aqueous medium, the toner components liquid is added to the aqueous medium while the aqueous medium is kept agitated. Usable emulsifier includes, but are not limited to, batch-type emulsifiers such as HOMOGINIZER (from IKA), POLYTRON (from KINEMATICA AG), and TK AUTO HOMOMIXER (from PRIMIX Corporation); continuous emulsifiers such as EBARA MILDER (from Ebara Corporation), TK FILMICS and TK PIPELINE HOMOMIXER (from PRIMIX Corporation); COLLOID MILL (from Kobelco Eco-Solutions Co., Ltd.), slasher and trigonal wet pulverizer (from NIPPON COKE & ENGINEERING Co., Ltd.), CAVITRON (from EUROTEC Co., Ltd.), and FINE FLOW MILL (from Pacific Machinery & Engineering Co., Ltd.); high-pressure emulsifiers such as MICRO FLUIDIZER (from MIZUHO Industrial Co., Ltd.), NANOMIZER (from NANOMIZER Inc.), and APV GAULIN (from SPX Corporation); film emulsifiers such FILM EMULSIFIER (from REICA Co., Ltd.); vibration emulsifiers such as VIBRO MIXER (from REICA Co., Ltd.); and ultrasonic emulsifier such as SONIFIER (from Branson Ultrasonics Corporation). In some embodiments, APV GAULIN, HOMOGINIZER, TK AUTO HOMOMIXER, EBARA MILDER, TK FILMICS, and TK PIPELINE HOMOMIXER are used for obtaining toner particles with a uniform size.

When the toner components liquid includes a modified polyester reactive with a compound having an active hydrogen group, the modified polyester starts reacting at the time of the emulsification. In some embodiments, the reaction time is 10 minutes to 40 hours or 2 to 24 hours.

Process 4: Removal of Organic Solvents. The organic solvent is removed from the emulsion. The organic solvent can be removed from the emulsion by (1) gradually heating the emulsion to completely evaporate the organic solvent from liquid droplets or (2) spraying the emulsion into dry atmosphere to completely evaporate the organic solvent from liquid droplets. In the latter case, aqueous dispersants, if any, can also be evaporated.

Usable recording media for use in methods and apparatuses according to some embodiments include, but are not limited to, sheet-like materials and three-dimensional materials having flat and/or curved surfaces. In some embodiments, materials (e.g., paper) covered with transparent toner are used. Usable materials include, but are not limited to, papers, fibers which may compose cloth, plastic films such as OHP sheets, metals, resins, and ceramics.

An electrophotographic method according to an embodiment includes a charging process, an irradiating process, a developing process, a transfer process, a fixing process, and an overcoat layer forming process. The method may optionally include other processes, such as a neutralization process, a cleaning process, and a recycle process, if needed. The charging process and the irradiating process may be collectively called as an electrostatic latent image forming process.

An electrophotographic apparatus according to an embodiment includes an electrophotographic photoreceptor, a charger, an irradiator, a developing device, a transfer device, a fixing device, and an overcoat layer forming device. The apparatus may optionally include other members, such as a neutralizer, a cleaner, and a recycler, if needed. The charger and the irradiator may be collectively called as an electrostatic latent image forming device.

The electrophotographic method according to an embodiment may be executed by the electrophotographic apparatus according to an embodiment. The charging process may be executed by the charger, the irradiating process may be executed by the irradiator, the developing process may be executed by the developing device, the transfer process may be executed by the transfer device, the fixing process may be executed by the fixing device, the overcoat layer forming process may be executed by the overcoat layer forming device, the neutralization process may be executed by the neutralizer, the cleaning process may be executed by the cleaner, and the recycle process may be executed by the recycler.

The electrostatic latent image forming process is a process which forms an electrostatic latent image on an electrophotographic photoreceptor. The electrostatic latent image forming device is adapted to form an electrostatic latent image on an electrophotographic photoreceptor.

The electrostatic latent image is formed by charging a surface of the electrophotographic photoreceptor and irradiating the charged surface with light containing image information. The electrostatic latent image forming device includes the charger for uniformly charging a surface of the electrophotographic photoreceptor and the irradiator for irradiating the charged surface with light containing image information.

The charger charges a surface of the electrophotographic photoreceptor by supplying a voltage thereto. The charger may be, for example, a contact charger equipped with a conductive or semiconductive roll, brush, film, or rubber blade, or a non-contact charger such as corotron and scorotron that use corona discharge.

The charger may include any type of charging member such as roller, magnetic brush, and fur brush. The magnetic brush may be comprised of ferrite particles (e.g., Zn—Cu ferrite), a non-magnetic conductive sleeve for supporting the ferrite particles, and a magnet roll internally contained in the sleeve. The fur brush may be comprised of a metallic or conductive cored bar and a fur which is treated with a conductive material such as carbon, copper sulfide, metal, or metal oxide, winding around or attaching to the cored bar.

In some embodiments, contact chargers are used for the purpose of reducing generation of ozone. In some embodiments, the charger is disposed in contact or non-contact with the electrophotographic photoreceptor, and supplies a direct current voltage overlapped with an alternating current voltage to the electrophotographic photoreceptor. In some embodiments, the charger is a non-contact charging roller disposed proximal to the electrophotographic photoreceptor, and charges a surface of the electrophotographic photoreceptor by being supplied with a direct current voltage overlapped with an alternating current voltage.

The irradiator irradiates the charged surface of the electrophotographic photoreceptor with light containing image information. The irradiator may be, for example, a radiation optical type, a rod lens array type, a laser optical type, or a liquid crystal shutter optical type. In some embodiments, the irradiator writes an electrostatic latent image on the electrophotographic photoreceptor by a digital method. The electrophotographic photoreceptor may be irradiated with light from the reverse surface (back surface) side thereof.

The developing process is a process which develops the electrostatic latent image into an unfixed toner image with a developer including the toner in accordance with an embodiment. The developing device is adapted to develop the electrostatic latent image into a toner image with the developer including the toner in accordance with an embodiment. In some embodiments, the developing device contains the developer and equipped with a developing member that supplies the toner to the electrostatic latent image with or without contacting the electrostatic latent image.

The developing device may employ either a dry developing method or a wet developing method. The developing device may be either a single-color developing device or a multicolor developing device. The developing device may be comprised of an agitator that frictionally agitates and charges the developer, and a rotatable magnet roller.

In the developing device, toner particles and carrier particles are mixed and agitated so that the toner particles are frictionally charged. The charged toner particles and carrier particles are borne on the surface of the magnet roller forming chainlike aggregations (hereinafter "magnetic brush"). The magnet roller is disposed adjacent to the electrophotographic photoreceptor. Therefore, a part of the toner particles in the magnetic brush migrates from the surface of the magnet roller to the surface of the electrophotographic photoreceptor due to electrical attractive force. As a result, the electrostatic latent image formed on the electrophotographic photoreceptor is developed into a toner image.

The developer contained in the developing device may be either a one-component developer or a two-component developer.

The transfer process is a process that transfers the toner image onto a recording medium. The transfer device is adapted to transfer the toner image onto a recording medium. In some embodiments, the toner image is primarily transferred onto an intermediate recording medium and secondarily transferred onto the recording medium. In some embodiments, a plurality of toner images with different colors is primarily transferred onto the intermediate recording medium to form a composite toner image and the composite toner image is secondarily transferred onto the recording medium.

The transfer device transfers a toner image from the electrophotographic photoreceptor by charging the electrophotographic photoreceptor. In some embodiments, the transfer device includes a plurality of primary transfer devices each transfers a toner image onto the intermediate recording medium to form a composite toner image, and a secondary transfer device that transfers the composite toner image onto the recording medium. The intermediate recording medium may be, for example, a transfer belt.

In some embodiments, the transfer device (including the primary transfer device and the secondary transfer device) contains a transfer unit that separates a toner image from the electrophotographic photoreceptor toward a recording medium side. The number of the transfer device may be one or more. The transfer unit may be, for example, a corona discharger, a transfer belt, a transfer roller, a pressure transfer roller, or an adhesive transfer unit.

The fixing process is a process which fixes the toner image on a recording medium. The fixing device is adapted to fix the toner image on a recording medium. Each single-color toner image may be independently fixed on a recording medium. Alternatively, a composite toner image including a plurality of color toner images may be fixed on a recording medium at once.

In some embodiments, the fixing device includes fixing members that fix a toner image by application of heat and pressure. For example, the fixing device may include a combination of a heating roller and a pressing roller, or a combination of a heating roller, a pressing roller, and an endless belt. In some embodiments, the heating member heats the toner image to a temperature of 80 to 200° C. In the fixing process, an optical fixer can be used in place of or in combination with the fixing device.

The overcoat layer forming process includes an application process and a hardening process. The overcoat layer forming device includes an applicator and a hardening device. The application process is a process which applies the electrophotographic overcoat composition according to an embodiment on the toner image on the recording medium. The applicator is adapted to apply the electrophotographic overcoat composition according to an embodiment to the toner image on the recording medium.

The electrophotographic overcoat composition is applied to the toner image either during or after the fixing process. In some embodiments, the electrophotographic overcoat composition may be applied to the toner image immediately after the toner image is fixed on the recording medium, like in-line coaters in which both printing and coating are performed within a single apparatus. Alternatively, in some embodiments, the electrophotographic overcoat composition may be applied to the toner image a short or long time after the toner image is fixed on the recording medium, like off-line coaters in which printing and coating are preformed by respective apparatuses.

The electrophotographic overcoat composition may be applied to either partial or entire surface of the toner image depending on the purpose, such as protection of printing surface or improvement in gloss.

The applicator may be, for example, a liquid film coater such as a roller coater, a flexo coater, a rod coater, a blade, a wire bar, an air knife, a curtain coater, a slide coater, a doctor knife, a screen coater, a gravure coater (e.g., an offset gravure coater), a slot coater, an extrusion coater, an inkjet coater, a normal or reverse rotation roller coater, and a lithographic coater.

In some embodiments, the applied layer of the electrophotographic overcoat composition has a thickness of 1 to 15 μm. When the thickness is less than 1 μm, the layer may repel or reduce its gloss. When the thickness is greater than 15 μm, the resulting image texture may be poor.

After the application process, the electrophotographic overcoat composition is hardened in the hardening process to form an overcoat layer. When the electrophotographic overcoat composition is photocurable, the electrophotographic overcoat composition is hardened by exposure to light (e.g., ultraviolet ray) emitted from a light source. When the electrophotographic overcoat composition is oil-based, the electrophotographic overcoat composition is hardened by application of heat.

The light source may be, for example, a low-pressure mercury lamp, a middle-pressure mercury lamp, a high-pressure mercury lamp, an ultrahigh-pressure mercury lamp, a xenon lamp, a carbon arc lamp, a metal halide lamp, a fluorescent lamp, a tungsten lamp, an argon ion laser, a helium-cadmium laser, a helium-neon laser, a krypton ion laser, a semiconductor laser, a YAG laser, a light-emitting diode, a CRT light source, a plasma light source, electron ray, γ ray, an ArF excimer laser, a KrF excimer laser, and an F2 laser.

Figure 4:
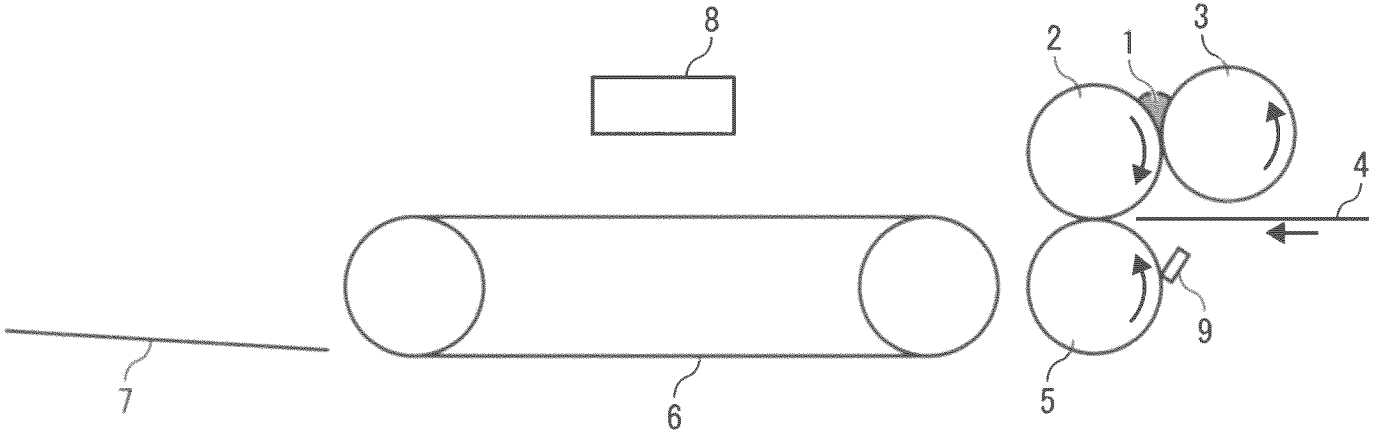
FIG. 4 is a schematic view of an overcoat layer forming device according to an embodiment.

FIG. 4 is a schematic view of an overcoat layer forming device according to an embodiment. The overcoat layer forming device includes an application roller 2, a metallic roller 3, a pressing roller 5, a conveyance belt 6, a tray 7, a light source 8, and a scraper 9. An electrophotographic overcoat composition 1 is accumulated in the space between the application roller 2 and the metallic roller 3.

A recording medium 4 having a toner image thereon is passed through the gap between the application roller 2 and the pressing roller 5 while contacting the application roller 2 and the pressing roller 5. Thus, the electrophotographic overcoat composition 1 on the surface of the application roller 2 is transferred onto the recording medium 4. The recording medium 4 applied with the electrophotographic overcoat composition 1 is conveyed by the conveyance belt 6 so as to pass below the light source 8. The electrophotographic overcoat composition 1 applied on the recording medium 4 is hardened into an overcoat layer by exposure to ultraviolet ray emitted from the light source 8. The recording medium 4 is then conveyed onto the tray 7. Residual electrophotographic overcoat composition 1 remaining on the pressing roller 5 is removed by the scraper 9.

The neutralization process is a process in which the neutralizer neutralizes the electrophotographic photoreceptor by applying a neutralization bias thereto. The neutralizer is adapted to neutralize the electrophotographic photoreceptor by applying a neutralization bias thereto. The neutralizer may be, for example, a neutralization lamp.

The cleaning process is a process in which the cleaner removes residual toner particles remaining on the electrophotographic photoreceptor. The cleaner is adapted to remove residual toner particles remaining on the electrophotographic photoreceptor. The cleaner may be, for example, a magnetic brush cleaner, an electrostatic brush cleaner, a magnetic roller cleaner, a blade cleaner, a brush cleaner, or a web cleaner.

The recycle process is a process in which the recycler supplies the residual toner particles collected in the cleaning process to the developing device. The recycler is adapted to supply the residual toner particles collected by the cleaner to the developing device. The recycler may be, for example, a conveyer.

The control process is a process in which the controller controls the above-described processes. The controller is adapted to control the above-described devices. The controller may be, for example, a sequencer or a computer.

Figure 5:
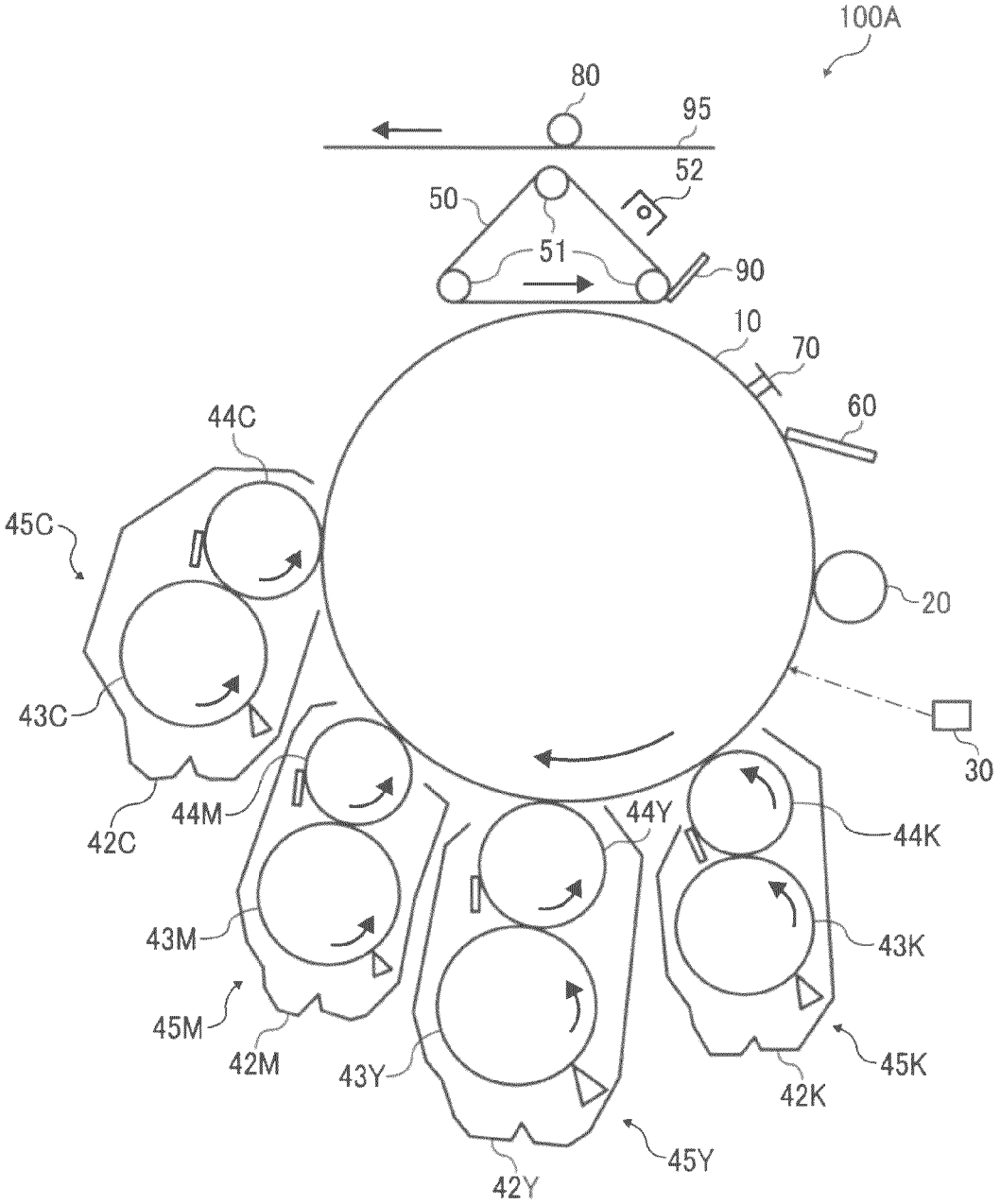
FIG. 5 is a schematic view of an electrophotographic apparatus according to an embodiment.

FIG. 5 is a schematic view of an electrophotographic apparatus according to an embodiment. An image forming apparatus 100A includes a photoreceptor drum 10, a charging roller 20, an irradiator, developing devices 45 (i.e., a black developing device 45K, an yellow developing device 45Y, a magenta developing device 45M, a cyan developing device 45C), an intermediate transfer medium 50, a cleaner 60, and a neutralization lamp 70.

An intermediate transfer medium 50 is a seamless belt stretched taut with three rollers 51 and is movable in a direction indicated by arrow in FIG. 5. One of the three rollers 51 is adapted to supply a primary transfer bias to the intermediate transfer medium 50. A cleaner 90 is disposed adjacent to the intermediate transfer medium 50. A transfer roller 80 is disposed facing the intermediate transfer medium 50. The transfer roller 80 is adapted to supply a secondary transfer bias for transferring a toner image onto a recording medium 95. A corona charger 52 is disposed facing the intermediate transfer medium 50 between the contact points of the intermediate transfer medium 50 with the photoreceptor drum 10 and the recording medium 95.

The black developing device 45K, yellow developing device 45Y, magenta developing device 45M, and cyan developing device 45C include respective developer containers 42K, 42Y, 42M, and 42C, respective developer supply rollers 43K, 43Y, 43M, and 43C, and respective developing rollers 44K, 44Y, 44M, and 44C.

In the image forming apparatus 100A, the photoreceptor drum 10 is uniformly charged by the charging roller 20 and then irradiated with a light beam 30 containing image information emitted from the irradiator so that an electrostatic latent image is formed on the photoreceptor drum 10. The electrostatic latent image is supplied with toners from the black developing device 45K, yellow developing device 45Y, magenta developing device 45M, and cyan developing device 45C. The resulting toner image is transferred onto the intermediate transfer medium 50 due to the primary transfer bias supplied from one of the rollers 51. The toner image on the intermediate transfer medium 50 is charged by the corona charger 52 and then further transferred onto the recording medium 95. Residual toner particles remaining on the photoreceptor drum 10 are removed by the cleaning device 60. The photoreceptor drum 10 is neutralized by the neutralization lamp 70. The image forming apparatus 100A further includes the above-described overcoat layer forming device disposed at an arbitrary position.

Figure 6:
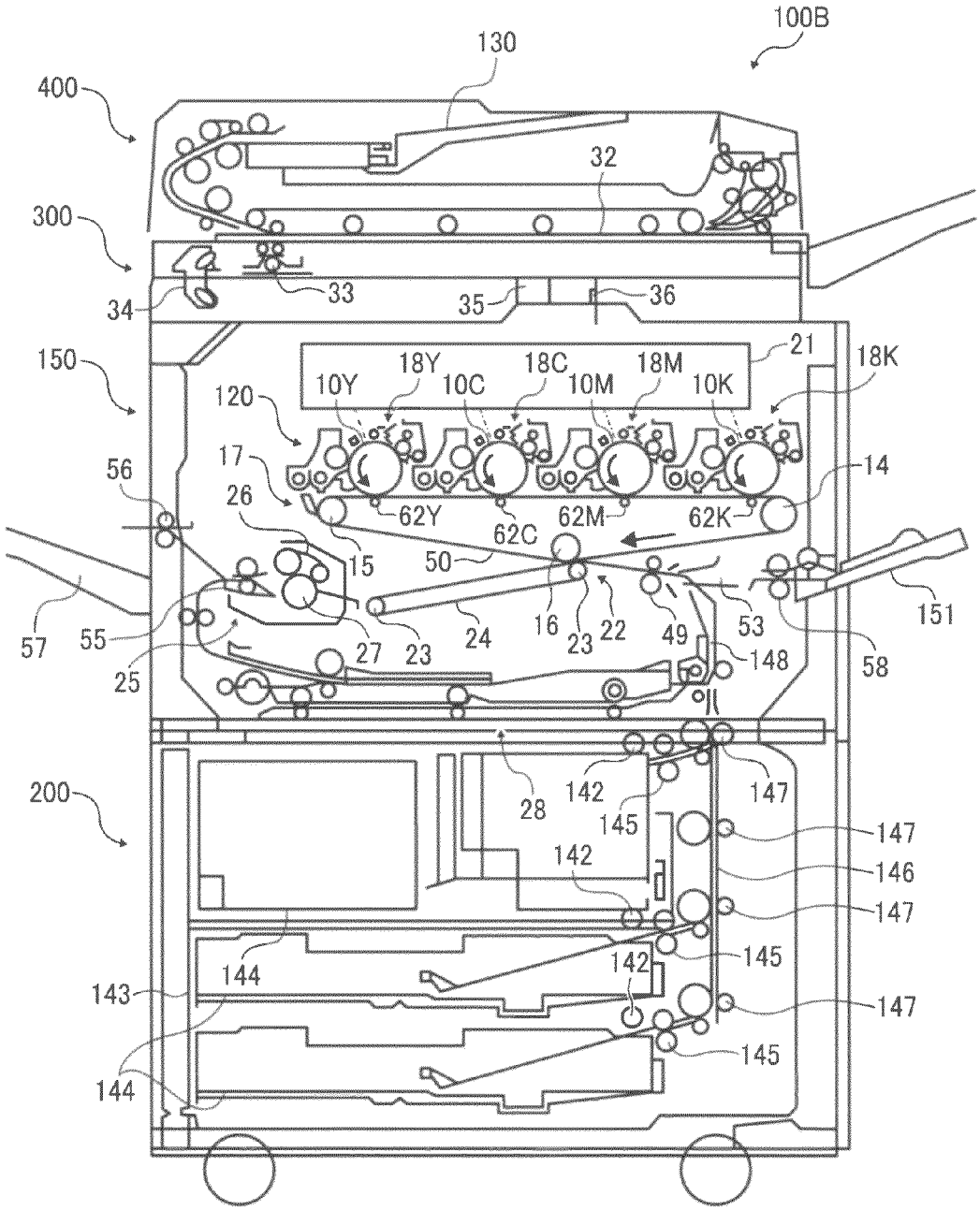
FIG. 6 is a schematic view of an electrophotographic apparatus according to another embodiment.

FIG. 6 is a schematic view of an electrophotographic apparatus according to another embodiment. An image forming apparatus 100B is a tandem-type full-color image forming apparatus including a main body 150, a paper feed table 200, a scanner 300, and an automatic document feeder (ADF) 400. A seamless-belt intermediate transfer medium 50 is disposed at the center of the main body 150. The intermediate transfer medium 50 is stretched taut with support rollers 14, 15, and 16 and is movable in a direction indicated by arrow in FIG. 6.

A cleaner 17 is disposed adjacent to the support roller 15. The cleaner 17 is adapted to remove residual toner particles remaining on the intermediate transfer medium 50. Four image forming units 18Y, 18C, 18M, and 18K (hereinafter collectively the "image forming units 18") adapted to form respective toner images of yellow, cyan, magenta, and cyan are disposed in tandem facing a surface of the intermediate transfer medium 50 stretched between the support rollers 14 and 15. The image forming units 18 forms a tandem developing device 120.

Figure 7:
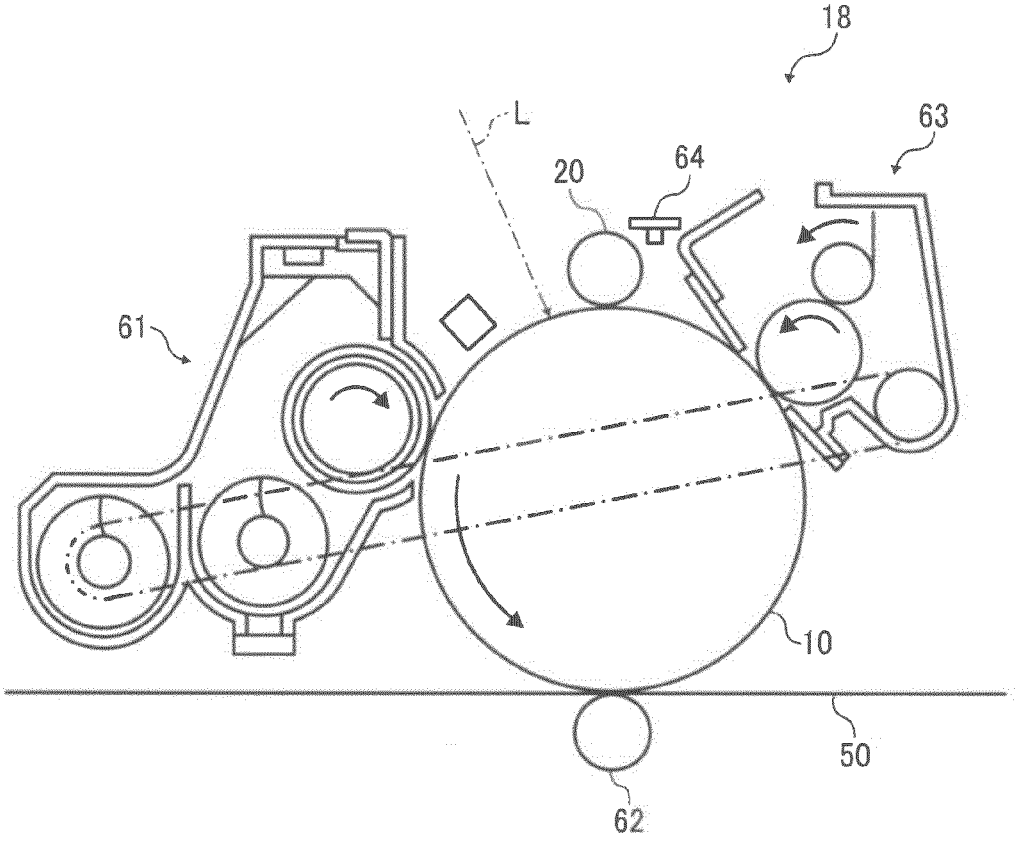
FIG. 7 is a magnified view of one of the image forming units illustrated in FIG. 6.

FIG. 7 is a magnified view of one of the image forming units 18. Each of the image forming units 18 includes a photoreceptor drum 10, a charging roller 20 adapted to uniformly charge the photoreceptor drum 10, a developing device 61 adapted to develop an electrostatic latent image into a toner image, a transfer roller 62 adapted to transfer the toner image onto the intermediate transfer medium 50, a cleaner 63, and a neutralization lamp 64.

Referring back to FIG. 6, an irradiator 21 is disposed adjacent to the tandem developing device 120. The irradiator 21 is adapted to emit light L onto the photoreceptor drums 10 (i.e., black photoreceptor 10K, yellow photoreceptor 10Y, magenta photoreceptor 10M, cyan photoreceptor 10C) to form respective electrostatic latent images thereon.

A secondary transfer device 22 is disposed on the opposite side of the tandem developing device 120 with respect to the intermediate transfer medium 50. The secondary transfer device 22 includes a seamless secondary transfer belt 24 stretched taut with a pair of rollers 23. The secondary transfer device 22 is configured such that the secondary transfer belt 24 conveys a recording medium while keeping the recording medium contacting the intermediate transfer medium 50.

An fixing device 25 is disposed adjacent to the secondary transfer device 22. The fixing device 25 includes a seamless fixing belt 26 and a pressing roller 27 pressed against the fixing belt 26.

A reversing device 28 adapted to reverse recording medium in duplexing is disposed adjacent to the secondary transfer device 22 and the fixing device 25.

The image forming apparatus 100B produces a full-color image in the manner described below. A document is set on a document table 130 of the automatic document feeder 400. Alternatively, a document is set on a contact glass 32 of the scanner 300 while lifting up the automatic document feeder 400, followed by holding down of the automatic document feeder 400. Upon pressing of a switch, in a case in which a document is set on the contact glass 32, the scanner 300 immediately starts driving so that a first runner 33 and a second runner 34 start moving. In a case in which a document is set on the automatic document feeder 400, the scanner 300 starts driving after the document is fed onto the contact glass 32. The first runner 33 directs light from a light source to the document, and reflects a light reflected from the document toward the second runner 34. A mirror in the second runner 34 reflects the light toward a reading sensor 36 through an imaging lens 35. The light is then received by a reading sensor 36. Thus, the document is read and image information of black, cyan, magenta, and yellow are obtained.

The irradiator 21 forms an electrostatic latent image on each photoreceptor drum 10 based on the image information. Each electrostatic latent image is developed into a toner image by each developing devices 61. The toner images of four colors are sequentially transferred onto the intermediate transfer medium 50 endlessly moving so that the toner images are superimposed on one another to form a composite toner image.

On the other hand, upon pressing of the switch, one of paper feed rollers 142 starts rotating in the paper feed table 200 so that a sheet of a recording medium is fed from one of paper feed cassettes 144 in a paper bank 143. The sheet is separated by one of separation rollers 145 and fed to a paper feed path 146. Feed rollers 147 feed the sheet to a paper feed path 148 in the main body 150. The sheet is stopped by a registration roller 49. Alternatively, a recording medium may be fed from a manual feed tray 151. A separation roller 58 separates a sheet of the recording medium and feeds it to a manual paper feed path 53. The sheet is stopped by the registration roller 49. Although the registration roller 49 is generally grounded, the registration roller 49 can be supplied with a bias for the purpose of removing paper powders from the sheet.

The registration roller 49 feeds the sheet to the gap between the intermediate transfer medium 50 and the secondary transfer device 22 in synchronization with an entry of the composite toner image formed intermediate transfer medium 50 into the gap. The recording medium having the composite toner image thereon is fed from the secondary transfer device 22 to the fixing device 25. In the fixing device 25, the composite toner image is fixed on the recording medium upon application of heat and pressure from the fixing belt 26 and the pressing roller 27. A switch claw 55 switches paper feed paths so that the sheet is discharged onto a discharge tray 57 by rotation of a discharge roller 56. Alternatively, the switch claw 55 switches paper feed paths so that the sheet gets reversed in the reversing device 28. After forming another toner image on the back side of the sheet, the sheet is discharged onto the discharge tray 57 by rotation of the discharge roller 56. After the composite toner image is transferred, residual toner particles remaining on the intermediate transfer medium 50 are removed by the cleaner 17. The image forming apparatus 100B further includes the above-described overcoat layer forming device disposed at an arbitrary position.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

In the following examples, isoparaffin content in wax and average molecular weight of wax were measured by a Field Desorption method using an instrument JMS-T100GC AccuTOF GC.

Example 1

Preparation of Toner 1 and Developer 1

First, 89 parts of a polyester resin (having a weight average molecular weight (Mw) of 68,200 and a glass transition temperature (Tg) of 65.5° C.), 5 parts of a microcrystalline wax (including 15% of isoparaffin and having an average molecular weight of 650), 5 parts of a carbon black (#44 from Mitsubishi Chemical Corporation), and 1 part of a charge controlling agent (Spilon Black TR-H from Hodogaya Chemical Co., Ltd.) were kneaded at 120° C. by a double axis extruder BCTA (from BUHULER). The kneaded mixture was pulverized into particles by an airflow pulverizer (JET MILL from Nisshin Engineering Inc.), and the particles were classified by size so as to collect particles having a weight average particle diameter of 11.0 μm. The collected particles were mixed with 2.2% of a silica (R-972 from Nippon Aerosil Co., Ltd.) by a HENSCHEL MIXER FM (from MITSUI MIIKE MACHINERY Co., Ltd.). Thus, a toner 1 was prepared. The toner 1 had an average circularity of 0.90 and a volume average particle diameter of 8 μm.

The toner 1 in an amount of 5.0% was mixed with a carrier comprised of magnetite particles having an average particle diameter of 50 μm covered with a silicon resin layer having a thickness of 0.5 μm. Thus, a developer 1 was prepared.

Preparation of Overcoat Composition 1

First, 10 parts of pentaerythritol tetraacrylate, 30 parts of trimethylolpropane triacrylate, and 0.3 parts of hydroquinone (a polymerization terminator) were contained in a beaker and heated to 120° C. while being agitated, and 50 parts of a diacryl phthalate prepolymer (DAISO DAP® 100 from DAISO CO., LTD.) was further dissolved therein. Further, 2 parts of aluminum isopropylate dispersed in 2 parts of toluene were gradually added thereto. The mixture was agitated for 20 minutes at 110° C. while removing the toluene therefrom. Thus, a photocurable varnish base was prepared.

Next, 75 parts of the photocurable varnish base, 60 parts of 1,6-hexanediol diacrylate as a polymerizable unsaturated compound, 10 parts of benzophenone as a photopolymerization initiator, 5 parts of p-dimethylaminoacetophenone, and 10 parts of phenyl glycol monoacrylate as a viscosity modifier were mixed and kneaded by a three-roll mill. Thus, a photocurable overcoat composition 1 was prepared. The polymerizable unsaturated compound content in the overcoat composition 1 was 37.5%.

Evaluations

Melting Test

A red toner image containing 0.8 mg/cm$^2$ of predetermined magenta and yellow toners was formed on an OHP sheet. The red toner image was subjected to a measurement of L*a*b* color coordinates by a spectrodensitometer (X-Rite 938 from X-Rite) while placing a blank OHP sheet thereon to prevent contamination. The OHP sheet was set to the overcoat composition dropping apparatus 102 (i.e., a melting tester) illustrated in FIG. 1. The dropping burette 104 was supplied with each overcoat composition and set to a position 10 mm higher from the OHP sheet. The overcoat composition in an amount of 0.3 to 0.5 mg/cm$^2$ was dropped on the OHP sheet and removed therefrom 10 seconds after. The red toner image from which the overcoat composition had been removed was subjected to a measurement of L*a*b* color coordinates by the spectrodensitometer (X-Rite 938 from X-Rite) again while placing a blank OHP sheet thereon. The AE defined in the formula (1) was calculated from the measured L*a*b* color coordinates.

Viscosity Measurement

Viscosity of each overcoat composition was measured by a B-type viscometer (from Toyo Seiki Seisaku-sho, Ltd.) at 25° C. The overcoat composition 1 had a viscosity of 200 mPa·s.

Preparation of Printing

Each developer was set in an electrophotographic apparatus IMAGIO MP C7500 and a solid image containing 0.4 mg/cm$^2$ of toner was printed on a POD gloss coated paper (from Oji paper Co., Ltd., 128 g/m$^2$).

Repellency Evaluation

Each overcoat composition was applied to each printing using an UV varnish coater (SG610V from Shinano Kenshi Co., Ltd.) at a coating speed of 10 m/min and an irradiance level of 120 W/cm so that the resulting layer had a thickness of 5 g/m$^2$ (4.5 μm). When the overcoat composition was photocurable, such an overcoat composition was further hardened by the coater. When the overcoat composition was oil-based, such an overcoat composition was dried in a chamber without being exposed to light. After the overcoat composition was hardened, the printing was visually observed to determine whether the overcoat composition was repelling the toner image or not. At the same time, the printing was visually observed to determine whether the toner image was disturbed or not.

Repellency was graded into the following four ranks.

◎: Overcoat composition was not repelling toner image.

○: Overcoat composition was slightly repelling toner image. No problem in practical use.

Δ: Overcoat composition was repelling toner image. No problem in practical use.

x: Overcoat composition was considerably repelling toner image.

Adhesiveness Evaluation

Each overcoat composition was applied to each printing using an UV varnish coater (SG610V from Shinano Kenshi Co., Ltd.) so that the resulting layer had a thickness of 5 g/m$^2$. When the overcoat composition was photocurable, such an overcoat composition was further hardened by the coater. When the overcoat composition was oil-based, such an overcoat composition was dried in a chamber without being exposed to light.

After the overcoat composition was hardened, adhesiveness was evaluated based on a method according to JIS K5400. Specifically, the printing having the overcoat layer was made a cut by a cutter knife in a grid pattern with each section having a length of 1 mm. An adhesive cellophane tape was attached thereon and peeled off therefrom. The grid pattern was visually observed with a loupe to count how many sections were remaining without being peeled off, and the ratio of the remaining sections to the total sections was calculated.

Adhesiveness was graded into the following four ranks based on the calculated ratio.

◎: The ratio was 100/100.

○: The ratio was 80/100 to 99/100.

Δ: The ratio was 40/100 to 79/100.

x: The ratio was 0/100 to 39/100.

Example 2

Preparation of Toner 2 and Developer 2

The procedure in Example 1 was repeated except for replacing the microcrystalline wax with a mixed wax of a microcrystalline wax and a paraffin wax (containing 8% of isoparaffin and having an average molecular weight of 520). Thus, a toner 2 and a developer 2 were prepared. The toner 2 had an average circularity of 0.90 and a volume average particle diameter of 7 μm.

Preparation of Overcoat Composition 2

A photocurable overcoat composition 2 was prepared by mixing the following materials for 20 minutes at 60° C.: 40 parts of a polyester acrylate oligomer (EBECRYL 846 from DAICEL-CYTEC Company LTD., having an Mw of 1,100), 30 parts of tripropylene glycol diacrylate, 50 parts of acryloyl morpholine as a polymerizable unsaturated compound, 0.2 parts of hydroquinone monomethyl ether as a polymerization inhibitor, 8 parts of benzoine ethyl ether as a photopolymerization initiator, and 3 parts of triisopropanolamine as a sensitizer. The polymerizable unsaturated compound content in the overcoat composition 2 was 38.1%.

The evaluation procedures in Example 1 were repeated except for replacing the developer 1 and the overcoat composition 1 with the developer 2 and the overcoat composition 2, respectively. The overcoat composition 2 had a viscosity of 450 mPa·s.

Example 3

Preparation of Toner 3 and Developer 3

The procedure in Example 1 was repeated except for replacing the microcrystalline wax with a mixed wax of a microcrystalline wax and a paraffin wax (containing 11% of isoparaffin and having an average molecular weight of 470). Thus, a toner 3 and a developer 3 were prepared. The toner 3 had an average circularity of 0.91 and a volume average particle diameter of 7.8 μm.

Preparation of Overcoat Composition 3

A photocurable overcoat composition 3 was prepared by mixing the following materials for 20 minutes at 60° C.: 10 parts of an urethane acrylate oligomer (EBECRYL 5129 from DAICEL-CYTEC Company LTD., having an Mw of 800), 40 parts of hexanediol diacrylate, 10 parts of cyclohexyl acrylate, 80 parts of ethyl carbitol acrylate as a polymerizable unsaturated compound, 0.2 parts of hydroquinone monomethyl ether as a polymerization inhibitor, and 6 parts of benzyl (1,2-diphenylethanedione) as a photopolymerization initiator. The polymerizable unsaturated compound content in the overcoat composition 3 was 54.7%.

The evaluation procedures in Example 1 were repeated except for replacing the developer 1 and the overcoat composition 1 with the developer 3 and the overcoat composition 3, respectively. The overcoat composition 3 had a viscosity of 20 mPa·s.

Example 4

Preparation of Overcoat Composition 4

A photocurable overcoat composition 4 was prepared by mixing the following materials for 20 minutes at 60° C.: 60 parts of a polyester acrylate oligomer (EBECRYL 1830 from DAICEL-CYTEC Company LTD., having an Mw of 1,500), 30 parts of ethylene oxide adducted bisphenol A diacrylate (V#700 from Osaka Organic Chemical Industry Inc.), 5 parts of 2-ethylhexyl acrylate, 20 parts of 1,6-hexanediol diacrylate as a polymerizable unsaturated compound, 0.4 parts of 2,6-di-tert-butyl-p-cresol (BHT) as a polymerization inhibitor, and 9 parts of IRGACURE 184 (from CIBA) as a photopolymerization initiator. The polymerizable unsaturated compound content in the overcoat composition 4 was 16.1%.

The evaluation procedures in Example 1 were repeated except for replacing the overcoat composition 1 with the overcoat composition 4. The overcoat composition 4 had a viscosity of 750 mPa·s.

Example 5

Preparation of Overcoat Composition 5

An overcoat composition 5 was prepared by mixing the following materials for 10 minutes at 30° C.: 100 parts of a varnish CARTONSELF GW (from DIC Corporation, comprising rosin-modified phenol resin varnish, polymerized linseed oil, light oil, and auxiliary agents such as a drier and a film stiffener) and 20 parts of ethyl carbitol acrylate as a polymerizable unsaturated compound. The polymerizable unsaturated compound content in the overcoat composition 5 was 16.7%.

The evaluation procedures in Example 1 were repeated except for replacing the overcoat composition 1 with the overcoat composition 5. The overcoat composition 5 had a viscosity of 300 mPa·s.

Example 6

Preparation of Overcoat Composition 6

The procedure in Example 1 was repeated except that the amount of the photocurable varnish base was changed from 75 parts to 70 parts and 5 parts of polyoxyethylene glycol alkyl ether as a surfactant were further added. Thus, an overcoat composition 6 was prepared. The polymerizable unsaturated compound content in the overcoat composition 6 was 37.5%.

The evaluation procedures in Example 1 were repeated except for replacing the overcoat composition 1 with the overcoat composition 6. The overcoat composition 6 had a viscosity of 185 mPa·s.

Example 7

Preparation of Overcoat Composition 7

The procedure in Example 4 was repeated except that the amount of the 2-ethylhexyl acrylate was changed from 5 parts to 3 parts and 2 parts of sodium dialkyl sulfosuccinate as an anionic surfactant were further added. Thus, an overcoat composition 7 was prepared. The polymerizable unsaturated compound content in the overcoat composition 7 was 16.1%.

The evaluation procedures in Example 1 were repeated except for replacing the overcoat composition 1 with the overcoat composition 7. The overcoat composition 7 had a viscosity of 420 mPa·s.

Example 8

Preparation of Overcoat Composition 8

The procedure in Example 5 was repeated except that the amount of the varnish CARTONSELF GW was changed from 100 parts to 96 parts and 4 parts of an alkylbenzene sulfonate as an anionic surfactant were further added. Thus, an overcoat composition 8 was prepared. The polymerizable unsaturated compound content in the overcoat composition 6 was 16.7%.The evaluation procedures in Example 1 were repeated except for replacing the overcoat composition 1 with the overcoat composition 8. The overcoat composition 8 had a viscosity of 270 mPa·s.

Example 9

Preparation of Toner 4

Preparation of Toner Components Liquid

Preparation of Unmodified (Low-Molecular-Weight) Polyester

A reaction vessel equipped with a condenser, a stirrer, and a nitrogen inlet pipe was charged with 67 parts of ethylene oxide 2 mol adduct of bisphenol A, 84 parts of propylene oxide 3 mol adduct of bisphenol A, 274 parts of terephthalic acid, and 2 parts of dibutyltin oxide. The mixture was subjected to a reaction for 8 hours at 230° C. under normal pressures. The mixture was further subjected to a reaction for 5 hours under reduced pressures of 10 to 15 mmHg. Thus, an unmodified polyester was prepared. The unmodified polyester had a number average molecular weight (Mn) of 2,100, a weight average molecular weight (Mw) of 5,600, and a glass transition temperature (Tg) of 55° C.

Preparation of Master Batch

First, 1,000 parts of water, 540 parts of a carbon black (PRINTEX 35 from Degussa, having a DBP oil absorption of 42 ml/100 g and a pH of 9.5), and 1,200 parts of the unmodified polyester were mixed using a HENSCHEL MIXER (from Mitsui Mining and Smelting Co., Ltd.). The resulting mixture was kneaded for 30 minutes at 150° C. using a double roll, the kneaded mixture was then rolled and cooled, and the rolled mixture was then pulverized into particles using a pulverizer (from Hosokawa Micron Corporation). Thus, a master batch was prepared.

Preparation of Prepolymer

A reaction vessel equipped with a condenser, a stirrer, and a nitrogen inlet pipe was charged with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. The mixture was subjected to a reaction for 8 hours at 230° C. under normal pressures. The mixture was further subjected to a reaction for 5 hours under reduced pressures of 10 to 15 mmHg. Thus, an intermediate polyester was prepared. The intermediate polyester had a number average molecular weight of 2,100, a weight average molecular weight of 9,600, a glass transition temperature (Tg) of 55° C., an acid value of 0.5, and a hydroxyl value of 49.

Another reaction vessel equipped with a condenser, a stirrer, and a nitrogen inlet pipe was charged with 411 parts of the intermediate polyester, 89 parts of isophorone diisocyanate, and 500 parts of ethyl acetate. The mixture was subjected to a reaction for 5 hours at 100° C. Thus, a prepolymer (i.e., a modified polyester reactive with a compound having an active hydrogen group) was prepared. The free isocyanate content in the prepolymer was 1.60% and the solid content in the prepolymer was 50% (after being left for 45 minutes at 150° C.).

Preparation of Ketimine (Compound having Active Hydrogen Group)

A reaction vessel equipped with a stirrer and a thermometer was charged with 30 parts of isophoronediamine and 70 parts of methyl ethyl ketone. The mixture was subjected to a reaction for 5 hours at 50° C. Thus, a ketimine compound (i.e., a compound having an active hydrogen group) was prepared. The ketimine compound had an amine value of 423.

Preparation of Styrene-Acrylic Copolymer Resin

A reaction vessel equipped with a condenser, a stirrer, and a nitrogen inlet pipe was charged with 300 parts of ethyl acetate, 300 parts of a mixture of styrene and acrylic monomers (styrene/2-ethylhexyl acrylate/acrylic acid/2-hydroxyethyl acrylate=75/15/5/5), and 10 parts of azobis isobutylnitrile. The mixture was subjected to a reaction for 15 hours at 60° C. in nitrogen atmosphere under normal pressures. After adding 200 parts of methanol, the mixture was further agitated for 1 hour, supernatant liquid was removed, and dried under reduced pressures. Thus, a styrene-acrylic copolymer resin was prepared.

Preparation of Toner Components Liquid

In a beaker, 10 parts of the prepolymer, 60 parts of the unmodified polyester, and 30 parts of the styrene-acrylic copolymer were dissolved in 130 parts of ethyl acetate. Further, 10 parts of a microcrystalline wax (including 15% of isoparaffin and having a molecular weight of 650) and 10 parts of the master batch were added to the beaker. The resulting mixture was then subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 msec. This dispersing operation was repeated 3 times (3 passes). Thereafter, 2.7 parts of the ketimine compound were further added to the mixture. Thus, a toner components liquid was prepared.

Preparation of Aqueous Medium

An aqueous medium was prepared by mixing and agitating 306 parts of ion-exchange water, 265 parts of a 10% suspension of tricalcium phosphate, and 0.2 parts of sodium dodecylbenzenesulfonate.

Preparation of Emulsion Slurry

While agitating 150 parts of the aqueous medium in a vessel at a revolution of 12,000 rpm using a TK HOMOMIXER (from PRIMIX Corporation), 100 parts of the toner components liquid were mixed therein for 10 minutes. Thus, an emulsion slurry was prepared.

Removal of Organic Solvents

A flask equipped with a stirrer and a thermometer was charged with 100 parts of the emulsion slurry. The emulsion slurry was agitated for 12 hours at 30° C. at a peripheral speed of 20 m/min so that the organic solvents were removed therefrom. Thus, a dispersion slurry was prepared.

Washing and Drying

First, 100 parts of the dispersion slurry was filtered under reduced pressures, and mixed with 100 parts of ion-exchange water using a TK HOMOMIXER for 10 minutes at a revolution of 12,000 rpm, followed by filtering, thus obtaining a wet cake (i).

The wet cake (i) was mixed with 300 parts of ion-exchange water using a TK HOMOMIXER for 10 minutes at a revolution of 12,000 rpm, followed by filtering. This operation was repeated twice, thus obtaining a wet cake (ii).

The wet cake (ii) was mixed with 20 parts of a 10% aqueous solution of sodium hydroxide using a TK HOMOMIXER for 30 minutes at a revolution of 12,000 rpm, followed by filtering under reduced pressures, thus obtaining a wet cake (iii).

The wet cake (iii) was mixed with 300 parts of ion-exchange water using a TK HOMOMIXER for 10 minutes at a revolution of 12,000 rpm, followed by filtering, thus obtaining a wet cake (iv).

The wet cake (iv) was mixed with 300 parts of ion-exchange water using a TK HOMOMIXER for 10 minutes at a revolution of 12,000 rpm, followed by filtering. This operation was repeated twice, thus obtaining a wet cake (v).

The wet cake (v) was mixed with 20 parts of a 10% hydrochloric acid using a TK HOMOMIXER for 10 minutes at a revolution of 12,000 rpm, followed by filtering, thus obtaining a wet cake (vi).

The wet cake (vi) was mixed with 300 parts of ion-exchange water using a TK HOMOMIXER for 10 minutes at a revolution of 12,000 rpm, followed by filtering. This operation was repeated twice, thus obtaining a wet cake (vii).

The wet cake (vii) was dried by a drier for 48 hours at 45° C. and filtered with a mesh having openings of 75 μm. Thus, a mother toner was prepared.

External Treatment

The mother toner in an amount of 100 parts was mixed with 0.6 parts of a hydrophobized silica having an average particle diameter of 100 nm, 1.0 part of a titanium oxide having an average particle diameter of 20 nm, and 0.8 parts of a hydrophobized silica having an average particle diameter of 15 nm using a HENSCHEL MIXER. Thus, a toner 4 was prepared. The toner 4 had an average circularity of 0.940 and a volume average particle diameter of 5.7 μm.

Preparation of Developer 4

A covering layer liquid was prepared by dispersing 21.0 parts of an acrylic resin solution (a toluene solution of a copolymer of cyclohexyl methacrylate/methyl methacrylate=80/20, prepared from monomers available from Mitsubishi Rayon Co., Ltd., having a solid content of 50%), 6.4 parts of a guanamine solution (SUPER BECKAMINE TD-126 from DIC Corporation, having a solid content of 70%), 7.6 parts of alumina particles (SUMICORUNDUM® AA-03 from Sumitomo Chemical Co., Ltd., having an average particle diameter of 0.3 μm, a specific resistivity of $10^{14}$ Ω·cm, and a weight average molecular weight of 55,000), 65.0 parts of a silicone resin solution (SR2410 from Dow Corning Toray Co., Ltd, having a solid content of 23%), 1.0 part of an aminosilane (SH6020 from Dow Corning Toray Co., Ltd, having a solid content of 100%), 60 parts of toluene, and 60 parts of butyl cellosolve, for 10 minutes using a HOMO-MIXER.

The covering layer liquid was applied to the surfaces of calcined ferrite particles ($(MgO)_{1.8}(MnO)_{49.5}(Fe_2O_3)_{48.0}$, having an average particle diameter of 35 μm) using a SPIRA COTA (from Okada Seiko Co., Ltd.), followed by drying, so that a covering layer having a thickness of 0.15 μm was formed thereon. The ferrite particles having the covering layer were further burnt in an electric furnace for 1 hour at 150° C. The burnt calcines ferrite particles were then pulverized with a sieve having openings of 106 μm. Thus, a carrier having a weight average particle diameter of 35 μm was prepared.

The carrier in an amount of 100 parts and the toner 4 in an amount of 7 parts were uniformly mixed using a TURBULA MIXER. Thus, a developer 4 was prepared.

The evaluation procedures in Example 1 were repeated except for replacing the developer 1 with the developer 4.

Example 10

Preparation of Toner 5 and Developer 5

The procedure in Example 9 was repeated except for replacing the microcrystalline wax with a mixed wax of a microcrystalline wax and a paraffin wax (containing 8% of isoparaffin and having an average molecular weight of 520). Thus, a toner 5 and a developer 5 were prepared. The toner 5 had an average circularity of 0.90 and a volume average particle diameter of 7.5 μm.

The evaluation procedures in Example 1 were repeated except for replacing the developer 1 with the developer 5.

Example 11

Preparation of Toner 6 and Developer 6

The procedure in Example 9 was repeated except for replacing the microcrystalline wax with a mixed wax of a microcrystalline wax and a paraffin wax (containing 11% of isoparaffin and having an average molecular weight of 470). Thus, a toner 6 and a developer 6 were prepared. The toner 6 had an average circularity of 0.95 and a volume average particle diameter of 5.8 μm.

The evaluation procedures in Example 1 were repeated except for replacing the developer 1 with the developer 6.

Example 12

Preparation of Toner 7 and Developer 7

The procedure in Example 1 was repeated except for replacing the microcrystalline wax with a paraffin wax (containing 2% of isoparaffin and having an average molecular weight of 400). Thus, a toner 7 and a developer 7 were prepared. The toner 7 had an average circularity of 0.90 and a volume average particle diameter of 7.6 μm.

The evaluation procedures in Example 1 were repeated except for replacing the developer 1 and the overcoat composition 1 with the developer 7 and the overcoat composition 2, respectively.

Example 13

Preparation of Toner 8 and Developer 8

The procedure in Example 9 was repeated except for replacing the microcrystalline wax with a paraffin wax (containing 2% of isoparaffin and having an average molecular weight of 400). Thus, a toner 8 and a developer 8 were prepared. The toner 8 had an average circularity of 0.95 and a volume average particle diameter of 5.7 μm.

The evaluation procedures in Example 1 were repeated except for replacing the developer 1 and the overcoat composition 1 with the developer 8 and the overcoat composition 3, respectively.

Example 14

The procedures in Example 3 were repeated except that the overcoat composition was applied to toner image area only. Because the overcoat composition was not applied to non-image area, only the image area was glossy.

Comparative Example 1

Preparation of Overcoat Composition 1X

The procedure in Example 1 was repeated except for replacing the 1,6-hexanediol diacrylate with 1,9-nonanediol diacrylate. Thus, an overcoat composition 1X was prepared. The polymerizable unsaturated compound content in the overcoat composition 1X was 37.5%.

The evaluation procedures in Example 1 were repeated except for replacing the overcoat composition 1 with the overcoat composition 1X. The overcoat composition 1X had a viscosity of 200 mPa·s.

Comparative Example 2

Preparation of Overcoat Composition 2X

The procedure in Example 2 was repeated except for replacing the acryloyl morpholine with 1,9-nonanediol diacrylate. Thus, an overcoat composition 2X was prepared. The polymerizable unsaturated compound content in the overcoat composition 2X was 38.1%.

The evaluation procedures in Example 2 were repeated except for replacing the overcoat composition 2 with the overcoat composition 2X. The overcoat composition 2X had a viscosity of 470 mPa·s.

Comparative Example 3

Preparation of Overcoat Composition 3X

The procedure in Example 3 was repeated except for replacing the ethyl carbitol acrylate with 1,9-nonanediol diacrylate. Thus, an overcoat composition 3X was prepared.

The evaluation procedures in Example 3 were repeated except for replacing the overcoat composition 3 with the overcoat composition 3X. The overcoat composition 3X had a viscosity of 40 mPa·s.

Comparative Example 4

Preparation of Overcoat Composition 4X

The procedure in Example 4 was repeated except for replacing the 1,6-hexanediol diacrylate with tripropylene glycol diacrylate. Thus, an overcoat composition 4X was prepared.

The evaluation procedures in Example 4 were repeated except for replacing the overcoat composition 4 with the overcoat composition 4X. The overcoat composition 4X had a viscosity of 770 mPa·s.

Comparative Example 5

Preparation of Overcoat Composition 5X

The procedure in Example 5 was repeated except for replacing the ethyl carbitol acrylate with tripropylene glycol diacrylate. Thus, an overcoat composition 5X was prepared.

The evaluation procedures in Example 5 were repeated except for replacing the overcoat composition 5 with the overcoat composition 5X. The overcoat composition 5X had a viscosity of 320 mPa·s.

Comparative Example 6

Preparation of Overcoat Composition 6X

The procedure in Example 6 was repeated except for replacing the 1,6-hexanediol diacrylate with tripropylene glycol diacrylate. Thus, an overcoat composition 6X was prepared.

The evaluation procedures in Example 6 were repeated except for replacing the overcoat composition 6 with the overcoat composition 6X. The overcoat composition 6X had a viscosity of 190 mPa·s.

Comparative Example 7

Preparation of Overcoat Composition 7X

The procedure in Example 7 was repeated except for replacing the 1,6-hexanediol diacrylate with tripropylene glycol diacrylate. Thus, an overcoat composition 7X was prepared.

The evaluation procedures in Example 7 were repeated except for replacing the overcoat composition 7 with the overcoat composition 7X. The overcoat composition 7X had a viscosity of 430 mPa·s.

Comparative Example 8

Preparation of Overcoat Composition 8X

The procedure in Example 8 was repeated except for replacing the ethyl carbitol acrylate with trimethylolpropane triacrylate. Thus, an overcoat composition 8X was prepared.

The evaluation procedures in Example 8 were repeated except for replacing the overcoat composition 8 with the overcoat composition 8X. The overcoat composition 8X had a viscosity of 310 mPa·s.

Comparative Example 9

The evaluation procedures in Example 9 were repeated except for replacing the overcoat composition 1 with the overcoat composition 1X.

Comparative Example 10

The evaluation procedures in Example 10 were repeated except for replacing the overcoat composition 1 with the overcoat composition 1X.

Comparative Example 11

The evaluation procedures in Example 11 were repeated except for replacing the overcoat composition 1 with the overcoat composition 1X.

Comparative Examples 12

The evaluation procedures in Example 12 were repeated except for replacing the overcoat composition 2 with the overcoat composition 2X.

Comparative Example 13

The evaluation procedures in Example 13 were repeated except for replacing the overcoat composition 3 with the overcoat composition 3X.

Comparative Example 14

Preparation of Overcoat Composition 9X The procedure in Example 1 was repeated except for changing the amount of the 1,6-hexanediol diacrylate to 10 parts. Thus, an overcoat composition 9X was prepared. The polymerizable unsaturated compound content in the overcoat composition 9X was 9.1%.

The evaluation procedures in Example 1 were repeated except for replacing the overcoat composition 1 with the overcoat composition 9X. The overcoat composition 9X had a viscosity of 280 mPa·s.

Comparative Example 15

Preparation of Overcoat Composition 10X

The procedure in Example 2 was repeated except for changing the amount of the acryloyl morpholine to 300 parts. Thus, an overcoat composition 10X was prepared. The polymerizable unsaturated compound content in the overcoat composition 10X was 78.7%.

The evaluation procedures in Example 2 were repeated except for replacing the overcoat composition 2 with the overcoat composition 10X. The overcoat composition 10X had a viscosity of 15 mPa·s.

Comparative Example 16

Preparation of Overcoat Composition 11X

The procedure in Example 3 was repeated except for changing the amount of the ethyl carbitol acrylate to 5 parts. Thus, an overcoat composition 11X was prepared. The polymerizable unsaturated compound content in the overcoat composition 11X was 7.0%.

The evaluation procedures in Example 3 were repeated except for replacing the overcoat composition 3 with the overcoat composition 11X. The overcoat composition 11X had a viscosity of 100 mPa·s.

Comparative Example 17

Preparation of Overcoat Composition 12X

The procedure in Example 4 was repeated except for changing the amount of the 1,6-hexanediol diacrylate to 200 parts. Thus, an overcoat composition 12X was prepared. The polymerizable unsaturated compound content in the overcoat composition 12X was 65.7%.

The evaluation procedures in Example 4 were repeated except for replacing the overcoat composition 4 with the overcoat composition 12X. The overcoat composition 12X had a viscosity of 200 mPa·s.

The evaluation results are shown in Table 1.

TABLE 1

| | Toners | | Overcoat Compositions | | | | | | Evaluation Results | |
|---|---|---|---|---|---|---|---|---|---|---|
| | | | | | | Polymerizable Unsaturated Compound | | | | |
| Examples | No. | Wax | No. | Behavior | Surfactant | Material | Content (%) | ΔE* in Melting Test | Repellency | Adhesiveness |
| 1 | 1 | W1 | 1 | Photocurable | N/A | A | 37.5 | 6 | ◎ | ◎ |
| 2 | 2 | W2 | 2 | Photocurable | N/A | B | 38.1 | 4.5 | ◎ | ○ |
| 3 | 3 | W2 | 3 | Photocurable | N/A | B | 54.7 | 28 | ◎ | ◎ |
| 4 | 1 | W1 | 4 | Photocurable | N/A | A | 16.1 | 3.5 | ◎ | ○ |
| 5 | 1 | W1 | 5 | Oil-based | N/A | C | 16.7 | 7 | ○ | ◎ |
| 6 | 1 | W1 | 6 | Photocurable | Used | A | 37.5 | 6.5 | ◎ | ◎ |
| 7 | 1 | W1 | 7 | Photocurable | Used | A | 16.1 | 5 | ◎ | ○ |
| 8 | 1 | W1 | 8 | Oil-based | Used | C | 16.7 | 8 | ◎ | ◎ |
| 9 | 4 | W1 | 1 | Photocurable | N/A | A | 37.5 | 5.8 | ◎ | ◎ |
| 10 | 5 | W2 | 1 | Photocurable | N/A | A | 37.5 | 5.3 | ◎ | ○ |
| 11 | 6 | W2 | 1 | Photocurable | N/A | A | 37.5 | 5.5 | ◎ | ○ |
| 12 | 7 | W3 | 2 | Photocurable | N/A | B | 38.1 | 4.2 | ○ | ○ |
| 13 | 8 | W3 | 3 | Photocurable | N/A | C | 54.7 | 26.5 | ○ | ◎ |
| 14 | 3 | W2 | 3 | Photocurable | N/A | C | 54.7 | 28 | ◎ | ◎ |
| Comp. 1 | 1 | W1 | 1X | Photocurable | N/A | X | 37.5 | 2 | Δ | Δ |
| Comp. 2 | 2 | W2 | 2X | Photocurable | N/A | X | 38.1 | 0.5 | Δ | X |
| Comp. 3 | 3 | W2 | 3X | Photocurable | N/A | X | 54.7 | 2.3 | X | Δ |
| Comp. 4 | 1 | W1 | 4X | Photocurable | N/A | Y | 16.1 | 0.2 | Δ | X |
| Comp. 5 | 1 | W1 | 5X | Oil-based | N/A | Y | 16.7 | 1.2 | X | Δ |
| Comp. 6 | 1 | W1 | 6X | Photocurable | Used | Y | 37.5 | 2 | Δ | Δ |
| Comp. 7 | 1 | W1 | 7X | Photocurable | Used | Z | 16.1 | 0.8 | Δ | X |
| Comp. 8 | 1 | W1 | 8X | Oil-based | Used | Z | 16.7 | 1 | Δ | X |
| Comp. 9 | 4 | W1 | 1X | Photocurable | N/A | X | 37.5 | 1.8 | Δ | Δ |
| Comp. 10 | 5 | W2 | 1X | Photocurable | N/A | X | 37.5 | 1.6 | X | X |
| Comp. 11 | 6 | W2 | 1X | Photocurable | N/A | X | 37.5 | 1.5 | X | X |
| Comp. 12 | 7 | W3 | 2X | Photocurable | N/A | X | 38.1 | 0.4 | X | X |
| Comp. 13 | 8 | W3 | 3X | Photocurable | N/A | X | 54.7 | 1.5 | X | X |
| Comp. 14 | 1 | W1 | 9X | Photocurable | N/A | A | 9.1 | 2.5 | Δ | Δ |
| Comp. 15 | 2 | W2 | 10X | Photocurable | N/A | B | 78.7 | 33 | Image blurring | Avaluative |
| Comp. 16 | 3 | W2 | 11X | Photocurable | N/A | C | 7.0 | 2 | Δ | Δ |
| Comp. 17 | 1 | W1 | 12X | Photocurable | N/A | A | 65.7 | 31 | Image blurring | Avaluative |

Legends for waxes in Table 1:
W1: Microcrystalline wax
W2: Microcrystalline/Paraffin mixed wax
W3: Paraffin wax
Legends for polymerizable unsaturated compounds in Table 1:
A: 1,6-Hexanediol diacrylate
B: Acryloyl morpholine
C: Ethyl carbitol acrylate
X: 1,9-Nonanediol diacrylate
Y: Tripropylene glycol diacrylate
Z: Trimethylolpropane triacrylate According to Examples 1 to 14, when ΔE* is within a range of 3 to 30, both repellency and adhesiveness of the overcoat composition are good. According to Comparative Examples 1 to 17, when ΔE* is out of the range of 3 to 30, either repellency or adhesiveness of the overcoat composition is poor.

Additional modifications and variations in accordance with further embodiments of the present invention are possible in light of the above teachings. It is therefore to be understood that within the scope of the appended claims the invention may be practiced other than as specifically described herein.

What is claimed is:

1. A method of evaluating electrophotographic overcoatability of a composition, comprising:

measuring a color (C1) of a toner image fixed on a sheet, the toner comprising a colorant and a resin;

dropping the composition on the toner image;

removing the composition from the toner image;

measuring a color (C2) of the toner image from which the composition has been removed; and calculating a color difference between the color (C1) of the toner image and the color (C2) of the toner image on which the composition is dropped and from which the composition is removed thereafter.

2. The method according to claim 1, further comprising:

determining if the composition has electrophotographic overcoatability based on whether or not the color difference is within a range of 3 to 30, the color difference being a color difference ΔE* defined in the L*a*b* color system, wherein the dropping includes dropping the composition in an amount of 0.3 to 0.5 mg/cm$^2$ on the toner image from a height of 10 mm, and wherein the removing includes removing the composition from the toner image 10 seconds after the dropping.

3. An electrophotographic overcoat composition, comprising:

a polymerizable unsaturated compound, wherein a color difference ΔE* defined in the L*a*b* color system between a color (C1) of a toner image and a color (C2) of the toner image on which the electrophotographic overcoat composition in an amount of 0.3 to 0.5 mg/cm$^2$ is dropped from a height of 10 mm and from which the electrophotographic overcoat composition is removed 10 seconds after is within a range of 3 to 30.

4. The electrophotographic overcoat composition according to claim 3, further comprising a surfactant.

5. The electrophotographic overcoat composition according to claim 3, wherein the electrophotographic overcoat composition is photocurable.

6. An electrophotographic method, comprising:

charging a surface of an electrophotographic photoreceptor;

irradiating the charged surface of the electrophotographic photoreceptor with light containing image information to form an electrostatic latent image thereon;

developing the electrostatic latent image into a toner image with a toner;

transferring the toner image onto a recording medium;

fixing the toner image on the recording medium; and forming a layer of the electrophotographic overcoat composition according to claim 3 on the toner image on the recording medium.

7. The electrophotographic method according to claim 6, wherein the toner comprises a wax.

8. An electrophotographic apparatus, comprising:

an electrophotographic photoreceptor;

a charger to charge a surface of the electrophotographic photoreceptor;

an irradiator to irradiate the charged surface of the electrophotographic photoreceptor with light containing image information to form an electrostatic latent image thereon;

a developing device to develop the electrostatic latent image into a toner image with a toner;

a transferring device to transfer the toner image onto a recording medium;

a fixing device to fix the toner image on the recording medium; and an overcoat layer forming device to form a layer of the electrophotographic overcoat composition according to claim 3 on the toner image on the recording medium.

9. The electrophotographic apparatus according to claim 8, wherein the toner comprises a wax.

10. The electrophotographic apparatus according to claim 9, wherein the toner image is a composite color toner image in which plurality of different color toner images are superimposed on one another.

* * * * *